US012655652B2

(12) United States Patent
Tremblay

(10) Patent No.: US 12,655,652 B2
(45) Date of Patent: Jun. 16, 2026

(54) FENCE ASSEMBLY

(71) Applicant: LA CORPORATION DE CLOTURES INC., Quebec (CA)

(72) Inventor: Jonathan Tremblay, Stoneham (CA)

(73) Assignee: LA CORPORATION DE CLOTURES INC., Quebec (CA)

( * ) Notice: Subject to any disclaimer, the term of this patent is extended or adjusted under 35 U.S.C. 154(b) by 174 days.

(21) Appl. No.: 18/546,152

(22) PCT Filed: Feb. 11, 2022

(86) PCT No.: PCT/CA2022/050202
§ 371 (c)(1),
(2) Date: Aug. 11, 2023

(87) PCT Pub. No.: WO2022/170436
PCT Pub. Date: Aug. 18, 2022

(65) Prior Publication Data

US 2024/0117653 A1 Apr. 11, 2024

(30) Foreign Application Priority Data

Feb. 12, 2021 (GB) ..... 2102020

(51) Int. Cl.
*E04H 17/20* (2006.01)
*E04H 17/00* (2006.01)
*E04H 17/14* (2006.01)

(52) U.S. Cl.
CPC ..... *E04H 17/1413* (2013.01); *E04H 17/006* (2021.01); *E04H 17/1447* (2021.01); *E04H 17/1456* (2021.01); *E04H 17/21* (2021.01)

(58) Field of Classification Search
CPC ... E04H 17/21; E04H 17/1413; E04H 17/006; E04H 17/1456; E04H 17/1447
(Continued)

(56) References Cited

U.S. PATENT DOCUMENTS 3,592,493 A * 7/1971 Goose ..... E06B 3/98 403/264
3,847,489 A * 11/1974 Van Riper ..... F16B 7/0446 248/245
(Continued)

FOREIGN PATENT DOCUMENTS

CN 204139722 U 2/2015
DE 202012103687 U1 * 11/2013 ..... E04H 17/1413
(Continued)

OTHER PUBLICATIONS

International Search Report and Written Opinion issued in corresponding International patent application No. PCT/CA2022/050202 on May 20, 2022.

*Primary Examiner* — Brian E Glessner
(74) *Attorney, Agent, or Firm* — BCF LLP

(57) ABSTRACT

The present technology relates to fence assemblies which are adaptable to various uses and can be used to build various fence configurations. According to certain embodiments, the fence assemblies of the present technology comprise a mount post having a first channel defined at least in part by side walls in the mount post body and a support stud configured to be inserted in the first channel and connected therein, the support stud having a support surface to support a rail and/or a panel extending transversely from the mount post.

19 Claims, 21 Drawing Sheets

(58) Field of Classification Search
USPC ..... 256/59, 65.02, 65.03
See application file for complete search history.

(56) References Cited

U.S. PATENT DOCUMENTS

| | | | | | |
|---|---|---|---|---|---|
| 3,879,017 | A * | 4/1975 | Maxcy | E04F 11/181 | 256/22 |
| 4,101,226 | A * | 7/1978 | Parisien | F16B 7/0446 | 403/4 |
| 5,702,090 | A * | 12/1997 | Edgman | E04H 17/1426 | 256/65.02 |
| 10,206,506 | B1 * | 2/2019 | Lai | A47B 96/1433 | |
| 11,598,116 | B1 * | 3/2023 | Palmegiani | E04H 17/21 | |
| 2007/0012904 | A1 * | 1/2007 | Zell | E04H 17/168 | 256/65.02 |
| 2016/0305150 | A1 * | 10/2016 | Volin | E04H 17/1417 | |
| 2017/0058557 | A1 * | 3/2017 | Wu | E04H 17/22 | |
| 2019/0284833 | A1 * | 9/2019 | Yeh | E04H 17/1447 | |
| 2020/0318383 | A1 * | 10/2020 | Feng | E04H 17/1447 | |
| 2024/0392601 | A1 * | 11/2024 | Schneider | E04H 17/21 | |

FOREIGN PATENT DOCUMENTS

| | | | | |
|---|---|---|---|---|
| EP | 2113618 | A1 * | 11/2009 | E04H 17/1447 |
| KR | 101415947 | B1 | 7/2014 | |
| KR | 200487249 | Y1 | 9/2018 | |

* cited by examiner

FENCE ASSEMBLY

The present application is a national phase entry of PCT International Application No.: PCT/CA2022/050202, filed Feb. 11, 2022, which claims priority to GB Patent Application No. 2102020.1, filed Feb. 12, 2021. Both applications are incorporated by reference herein in their entirety.

FIELD OF THE DISCLOSURE

The present application relates to fence assemblies.

BACKGROUND OF THE DISCLOSURE

Fence assemblies are commonly used in various forms to protect and secure people, animals and land.

Fence assemblies currently existing on the market however suffer from various drawbacks including the lack of versatility to construct different fence models having a variety of profiles and uses.

Known fence assemblies are also overly complex and require complicated or many steps to piece together a large number of components. As a result, disassembly of such fence assemblies to gain access to components, such as during maintenance or replacement of damaged parts, is also a complex process requiring an excessive amount of labor and time as all or portions of the components must be disassembled to gain such access.

Some existing fences also leave support hard-ware and components exposed following assembly, rendering the exposed components vulnerable to weathering and wear and tear, as well as failing to provide an aesthetically pleasing finish to the fence assembly.

Therefore, there is a need for a fence assembly which overcomes or reduces at least some of the above-described problems.

SUMMARY OF THE DISCLOSURE

Certain aspects and embodiments of the present technology overcome or reduce at least some of the problems of known fence assemblies.

Broadly, according to certain aspects and embodiments of the present technology, there is provided a fence assembly which is modular and adaptable to various uses which can be used to build various fence configurations.

From one aspect there is provided a fence assembly comprising a mount post having a mount post body with a longitudinal axis. The mount post body has a base end, a top end, and a first channel defined at least in part by side walls in the mount post body and extending parallel to the longitudinal axis. The fence assembly further comprises a support stud configured to be connected to the mount post having a support surface to support a rail and/or a panel extending transversely from the mount post. The support stud comprises a support stud body having a tail portion and a head portion. The support stud is configured to be inserted in the first channel with the tail portion first such that a front face of the head portion faces outwardly from the first channel. The support stud further comprises a bore extending from a first open bore end at the head portion to a second open bore end at the tail portion, the bore being sized and shaped to receive a fastener such that the fastener extends through the bore and beyond the second open bore end into the first channel for connecting the support stud to the mount post.

From another aspect there is provided a mount post for a fence assembly, the mount post having a mount post body with a longitudinal axis. The mount post body has a base end and a top end, and a first channel defined at least in part by side walls in the mount post body and extending parallel to the longitudinal axis.

From a further aspect there is provided a support stud for a fence assembly, the support stud being configured to be connected to a mount post. The support stud has a support surface for supporting a rail and/or a panel and comprises a support stud body having a tail portion and a head portion having a front face, the head portion having a larger width than a width of the tail portion. The support stud further comprises a bore extending from a first open bore end at the head portion to a second open bore end at the tail portion, the bore being sized and shaped to receive a fastener such that the fastener extends through the bore and beyond the second open bore end.

In certain embodiments of any one or more of the preceding aspects, the mount post body has a second channel defined therein, the second channel extending parallel to the longitudinal axis, and spaced circumferentially from the first channel. In other embodiments, the mount post body has a third channel defined therein, the third channel extending parallel to the longitudinal axis, and spaced circumferentially from the first and second channels. In certain embodiments of any one or more of the preceding aspects, the side walls of the first channel have a step formed therein. The step defines a channel base portion having a channel base width, and a channel mouth portion having a channel mouth width, wherein the channel mouth width is larger than the channel base width, and the channel base portion is closer to the longitudinal axis than the channel mouth portion.

In certain embodiments of any one or more of the preceding aspects, the tail portion of the support stud has a tail portion width which is less than the channel base width such that the tail portion can extend into the channel base portion of the first channel. The head portion of the support stud however has a head portion width which is wider than the channel base width such that the head portion rests on the step and can not be received in the channel base portion.

In certain embodiments of any one or more of the preceding aspects, the second bore open end is at a junction of the tail portion and the head portion. In certain embodiments, there may be provided at least one opening in the side wall of the channel, the at least one opening being configured to receive a fastener of the support stud to secure the support stud to the mount post.

In certain embodiments of any one or more of the preceding aspects, the bore comprises a first bore and a second bore, the first and second bores being divergent as they extend from the head portion towards the tail portion of the support stud. In other embodiments, the bore comprises a third bore between the first bore and the second bore, the third bore extending parallel to a central axis of the support stud. In further embodiments, the first bore is angled at about 45 degrees from the central axis in one direction and the second bore is angled at about 45 degrees from the central axis in another direction.

In certain embodiments of any one or more of the preceding aspects, the front face of the head portion has an inset portion defined by inset walls, the first open bore end being defined in the inset walls. In certain implementation of these embodiments, the inset walls have five sides angled with respect to one another with the first open bore end extending from one of the five sides. In other embodiments, the bore comprises a first bore, a second bore and a third bore, with the first and second bores being divergent as they extend from the head portion towards the tail portion of the support stud at an angle of 45 degrees respectively from the third bore, and the first open end of the first bore, the second bore and the third bore are on respective adjacent faces of the inset wall.

In certain embodiments of any one or more of the preceding aspects, a pair of arms extend upwardly from the front face of the support stud to define the support surface for the panel.

In certain embodiments of any one or more of the preceding aspects, a first channel cover is provided. The first channel cover has a channel cover body sized and shaped to cover the first channel, and a pair of channel cover arms, each channel cover arm extending transversely from a respective side of the channel cover body and configured to be received in the first channel. In certain implementation of these embodiments, each channel cover arm may further comprise a protrusion extending transversely therefrom, there being provided a corresponding notch in the side walls of the first channel for receiving the protrusion.

In certain embodiments of any one or more of the preceding aspects, a mount post base plate may be provided which can be attached to the base end of the mount post, the mount post base plate having base plate openings formed therein through which fasteners can be extended to attach to the mount post.

In certain embodiments of any one or more of the preceding aspects, a mount post top cover may be provided which can be attached to the top end of the mount post, the mount post top cover being sized and shaped to cover the top end of the mount post.

In certain embodiments of any one or more of the preceding aspects, the rail is configured to be mounted to the mount post transversely to the longitudinal axis, the rail comprising two free ends, each free end sized and shaped to be received in the first channel. In certain embodiments, the rail is four-sided, with one of the four-sides having a rail channel formed therein. In other embodiments, a rail channel cover may be provided to cover the rail channel. According to certain embodiments, the rail channel cover comprises a rail channel cover body sized and shaped to cover the rail channel, and a pair of rail channel cover arms, each channel cover arm extending transversely from a respective side of the rail channel cover body and configured to be received in the rail channel. In certain embodiments, each rail channel cover arm further comprises a protrusion extending transversely therefrom, there being provided a corresponding notch in the side walls of the rail channel for receiving the protrusion.

In further embodiments, a rail end cover may be provided for covering one of the free ends of the rail, the rail end cover comprising a face and a protrusion extending from the face configured to be received in the free end of the rail.

In certain embodiments of any one or more of the preceding aspects, the fence assembly further comprise a panel configured to be supported by the support stud. In other embodiments the panel may configured to be received in the rail channel of the rail.

In a further aspect, there is provided a frame assembly comprising a plurality of rails, each one of the plurality of rails comprising two free ends and side walls having a rail channel formed therein. The frame assembly further comprises a plurality of connectors, each of the plurality of connectors having a connector body comprising a first portion, and a second portion extending transversely from the first portion. The body of the connector further comprises a first end and a second end, the first and second ends are each configured to engage one of the two free ends of one of the plurality of rails. In certain embodiments, the first and the second ends of the connector body each comprise a cavity being sized and shaped to receive one of the two free ends of one of the plurality of rails therein.

It will be appreciated that in certain embodiments of the fence assembly, various components of the fence assembly described herein can be provided as a kit for assembly by a user of the fence assembly. The kit may include one or more mount posts, one or more rails, one or more support studs, and one or more covers for the mount posts and rails.

In certain embodiments, the divergent first and second bores of the support stud, can provide for an improved attachment of the support stud to the mount post due to the resultant divergent angle of the respective fasteners, such as screws, received in the first and second bores. This can increase the stability of the fence assembly once assembled.

In certain embodiments, when the support stud is provided with an inset portion, it can protect a head of the fastener when it is inserted in a respective bore from unfavourable conditions, such as heat, humidity, cold, and may therefore help to prolong a life of the fastener and hence the secure attachment of the support stud to the mount post. The inset portion may also provide an esthetic appearance to the support stud.

Definitions

The use of "including", "comprising", or "having", "containing", "involving" and variations thereof herein, is meant to encompass the items listed thereafter as well as, optionally, additional items. In the following description, the same numerical references refer to similar elements.

It must be noted that, as used in this specification and the appended claims, the singular form "a", "an" and "the" include plural referents unless the context clearly dictates otherwise.

As used herein, the term "about" in the context of a given value or range refers to a value or range that is within 20%, preferably within 10%, and more preferably within 5% of the given value or range.

As used herein, the term "and/or" is to be taken as specific disclosure of each of the two specified features or components with or without the other. For example, "A and/or B" is to be taken as specific disclosure of each of (i) A, (ii) B and (iii) A and B, just as if each is set out individually herein.

In the context of the present specification, unless expressly provided otherwise, the words "first", "second", "third", etc. have been used as adjectives only for the purpose of allowing for distinction between the nouns that they modify from one another, and not for the purpose of describing any particular relationship between those nouns. Thus, for example, it should be understood that, the use of the terms "first channel" and "third channel" is not intended to imply any particular order, type, chronology, hierarchy or ranking (for example) of/between the channels, nor is their use (by itself) intended to imply that any "second channel" must necessarily exist in any given situation.

BRIEF DESCRIPTION OF DRAWINGS

Further aspects and advantages of the present invention will become better understood with reference to the description in association with the following in which.

DETAILED DESCRIPTION

Figure 1:
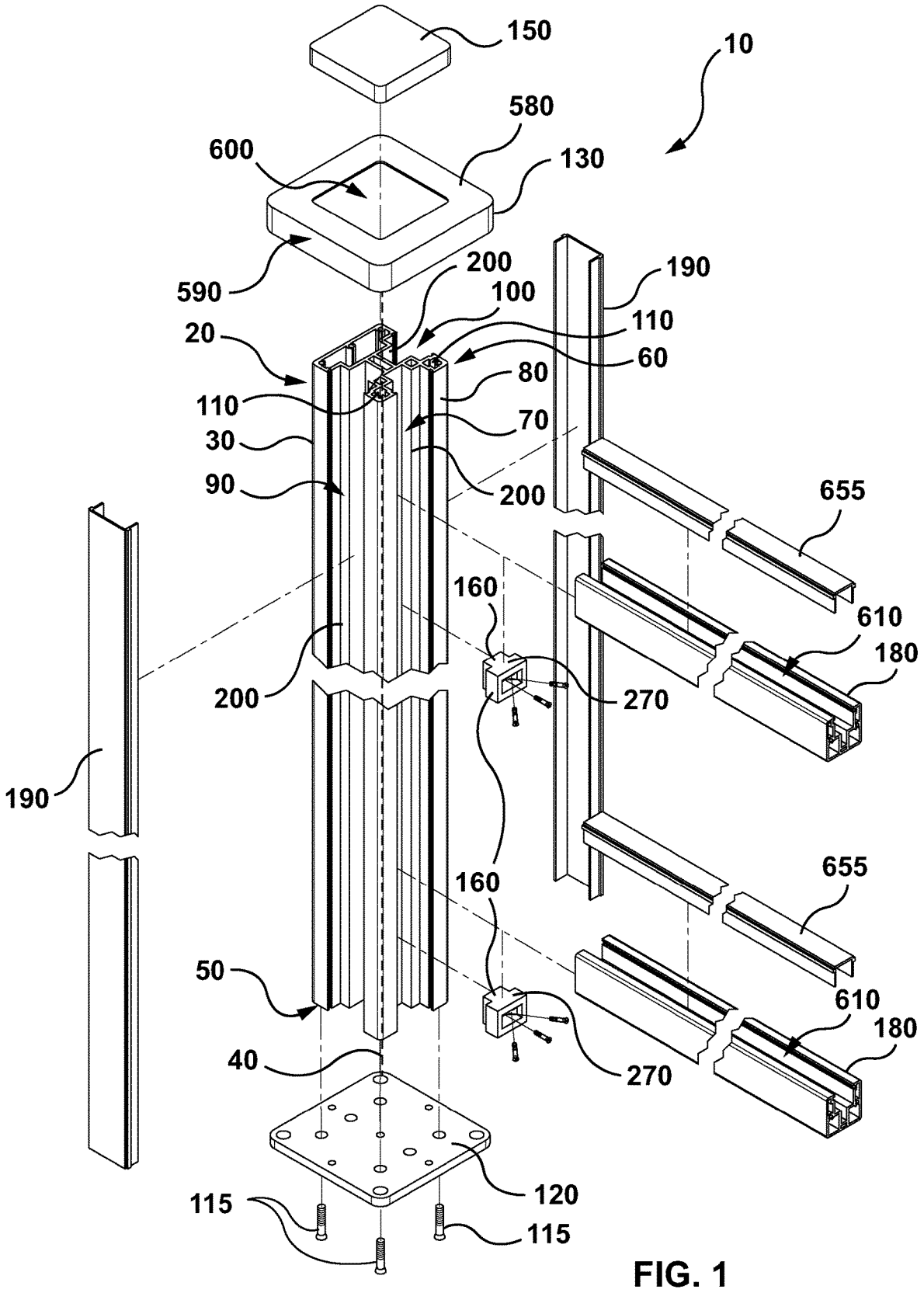
FIG. 1 illustrates an exploded view of a fence assembly, the fence assembly including a mount post, rails, rail covers, support studs, channel covers, and mount post base plate, according to certain embodiments of the present technology.

The present disclosure is not limited in its application to the details of construction and the arrangement of components set forth in the following description or illustrated in the drawings. The disclosure is capable of other embodiments and of being practiced or of being carried out in various ways. Also, the phraseology and terminology used herein is for the purpose of description and should not be regarded as limiting. The use of "including", "comprising", or "having", "containing", "involving" and variations thereof herein, is meant to encompass the items listed thereafter as well as, optionally, additional items. In the following description, the same numerical references refer to similar elements.

Referring first to FIG. 1, an exploded view of a fence assembly (also referred to as a versatile system) 10 according to an embodiment of the present technology is shown. Advantageously, as will be discussed in greater detail below, embodiments of the fence assembly of the present technology are adaptable to various uses and can be used to build various fence configurations. The fence assembly comprises a number of modular components that can be connected together in various different configurations. At least some of the components of the fence assembly 10 of the present technology are preferably made of material resistant to corrosion. In some embodiments, the components of the fence assembly (10) are made of one or more of aluminum, stainless steel, or the like.

The fence assembly 10 comprises a mount post (also referred to as post) 20 having a mount post body 30 with a longitudinal axis 40. The mount post body 30 has a base end 50 and a top end 60. The mount post body 30 is four-sided and comprises a first 70 channel, a second channel 90 and a third channel 100 formed along respective different sides 80 of the mount post body 30. Each of the first, second and third channels 70, 90, and 100 are open ended and extend between the base end 50 and the top end 60 of the mount post 20. The first, second and third channels 70, 90, and 100 are parallel to the longitudinal axis 40 of the mount post 20 and are spaced circumferentially from each other. Each of the first, second and third channels 70, 90 and 100 is defined at least in part by side walls 200 in the mount post body 30. Each of the first, second and third channels 70, 90 and 100 is configured to selectively receive other components of the fence assembly 10 including rails and support studs, which will be described in more detail below. When not in use, each of the first, second and third channels 70, 90, and 100 are configured to be closed by a channel cover 190.

In other embodiments, the mount post body 30 may only include a single channel, two channels, or more than three channels. For example, the mount post body 30 may include the first channel 70, or only the first and second channels 70, 90. In other embodiments, the mount post body 30 may further comprise a fourth channel (not shown) defined therein, similar to the first, second and third channels 70, 90, 100, provided on a fourth side of the mount post 20. The first, second and third channels 70, 90, and 100 are illustrated herein as having the same configuration in terms of size or shape, but in certain other embodiments, their configuration may differ from one another.

Still referring to FIG. 1, the mount post body 30 is hollow and has apertures 110 extending therethrough. At least some of the apertures 110 may be configured, at least in part, for minimizing material used without compromising mechanical properties of the mount post body 30. The apertures 110 can have any suitable form and may differ from that as illustrated.

At least some of the apertures 110 may also be configured for receiving fasteners for fixing other components to the mount post 20.

For example, the fence assembly 10 may be provided with a mount post base plate (also referred to as base plate) 120 which is attachable to the base end 50 of the mount post 20 for supporting the mount post 20 on a given surface. The mount post base plate 120 may be secured to the mount post 20 using fasteners 115 which are received into at least some of the apertures 110. In this respect, in some embodiments, some of the apertures 110 are sized and shaped to retain the fastener 115 therein when it extends through the mount post base plate 120.

Further, the fence assembly 10 may be provided with a mount post top cover (also referred to as base cover) 130. In this respect, the top end 60 of the mount post 20 is configured to have connected thereto the mount post top cover 130. The mount post top cover 130, in certain embodiments, is configured to close or seal the top end 60 of the mount post 20 to avoid or minimize infiltration of water, dirt, snow etc. into the apertures 110 or any of the channels 70, 90, 100. The mount post top cover 130, in certain embodiments, is also configured to provide a smooth and esthetically pleasing finish for the top end 60 of the mount post 20.

Figure 3:
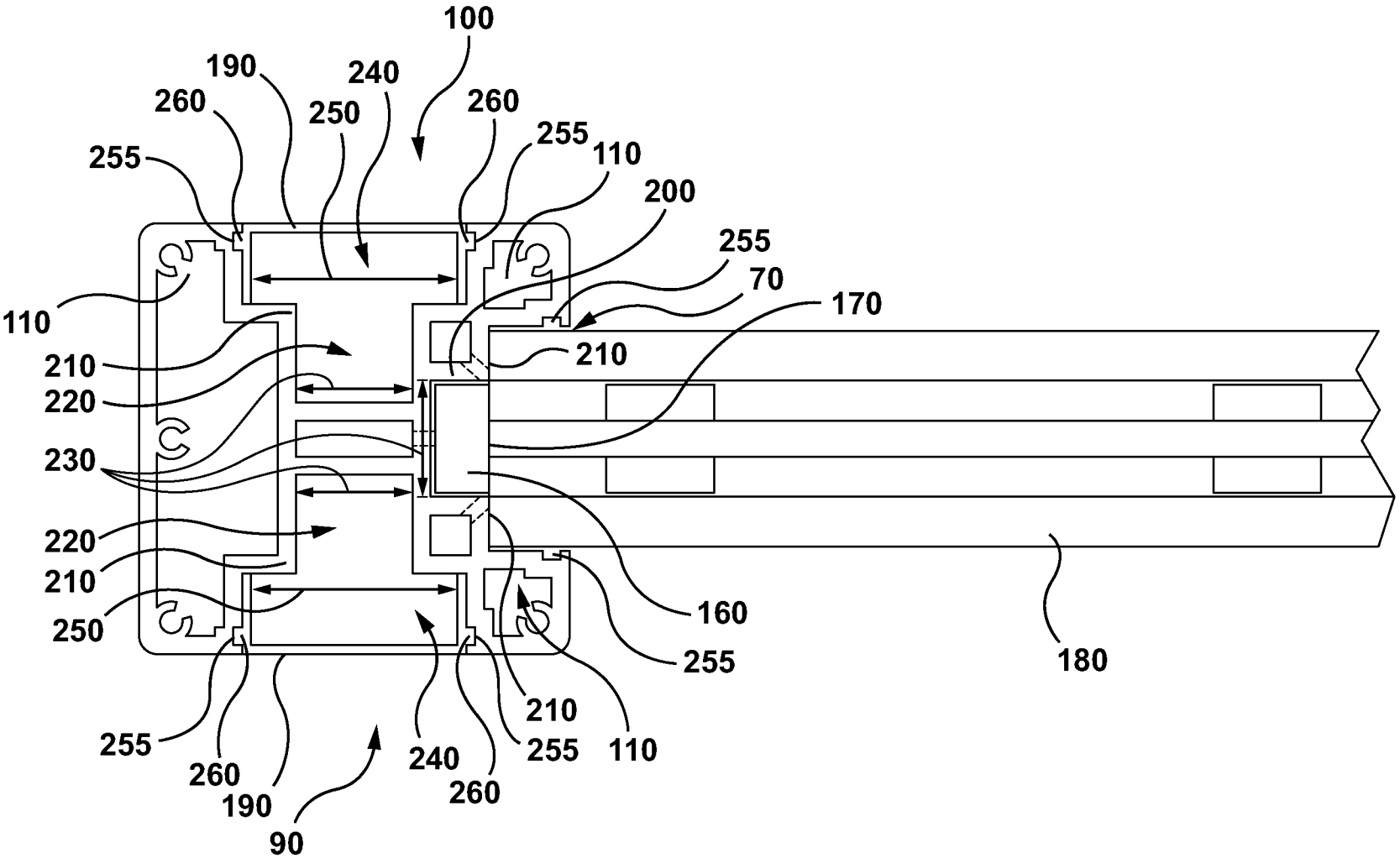
FIG. 3 illustrates a top view of the mount post and one of the rails of FIG. 1.

The fence assembly 10 may also be provided with one or more channel covers (also referred to as side post cover) 190, each of which is configured to cover the first channel 70, the second channel 90 or the third channel 100. In this respect, if the fence assembly 10 includes a mount post 20 with three channels yet only one channel is required to be used to construct the fence, the channels which are not required can be covered by the channel cover 190. For example, as best seen in FIG. 3, in certain embodiments in which the first channel 70 is to be used, the second and third channels 90, 100 can each be covered by the channel cover 190. Use of channel covers 190 can not only prevent ingress of dirt and liquids into the channel but also provide an esthetic finish.

Figure 4:
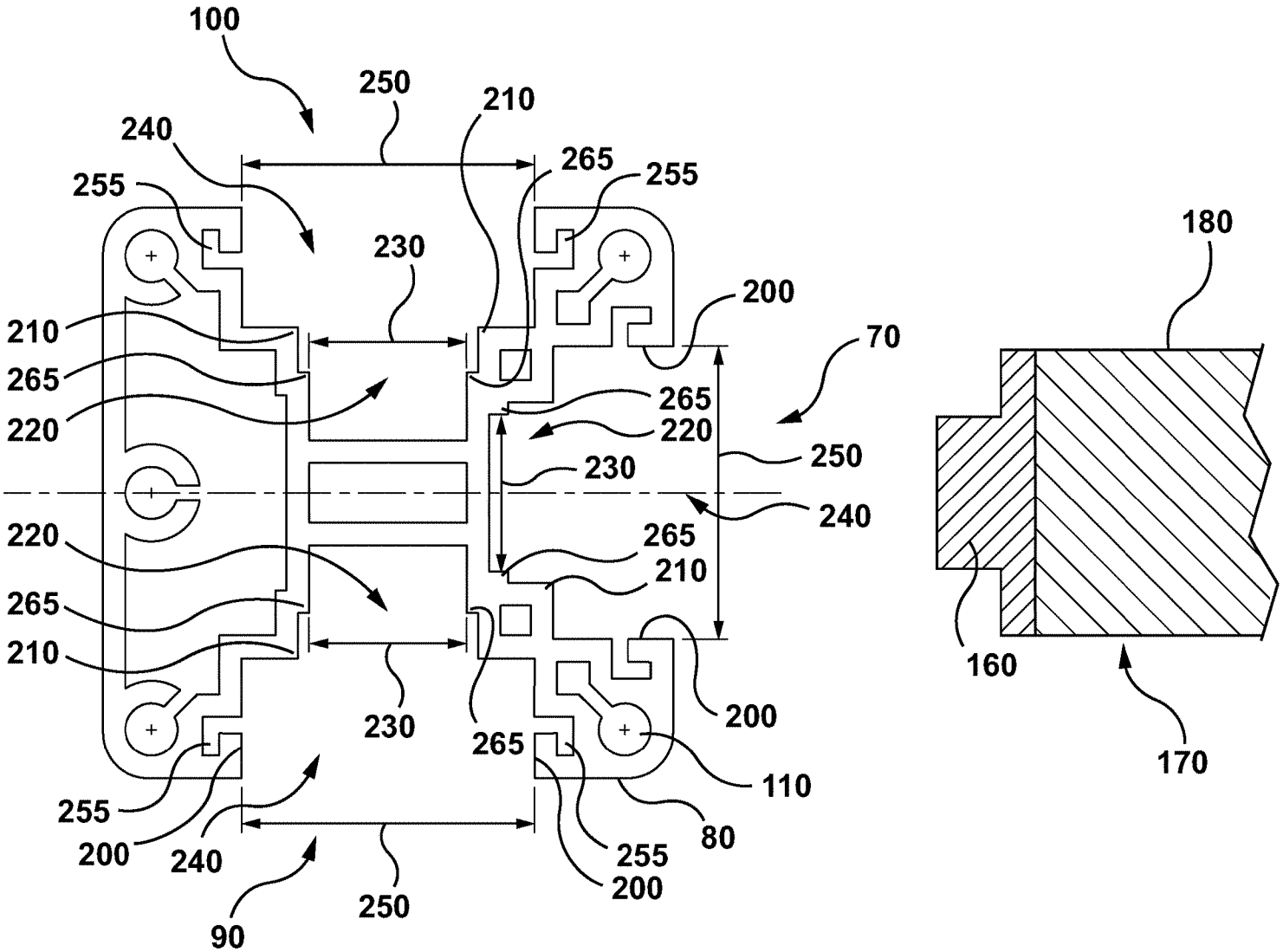
FIG. 4 illustrates a top view of an alternative embodiment of the mount post of FIG. 1, according to certain embodiments of the present technology with the support stud and rail detached.

Turning now to FIGS. 3 and 4, the first channel 70 will be described in greater detail. As mentioned above, in the embodiments illustrated herein, the second and third channels 90, 100 correspond in size and shape to the first channel 80 so the description for the first channel 70 is equally applicable to the second and third channels 90, 100. As best seen in FIG. 3, the first channel 70 is configured to receive one or more of a support stud (also referred to as a connector) 160, a free end 170 of a rail (or handrail and/or bottom rail) 180 and/or a panel therewith. The side walls 200 of the first channel 70 comprises a step 210 formed therein. The step 210 defines a channel base portion 220 having a channel base width 230, and a channel mouth portion 240 having a channel mouth width 250, the channel mouth width 250 being larger than the channel base width 230. The channel base portion 220 is closer to the longitudinal axis 40 than the channel mouth portion 240. The side walls 200 of the first channel 70 further define a pair of notches 255 in the channel mouth portion 240 which flank said mouth portion 240. Each notch 255 is sized and shaped to receive and secure a respective protrusion 260 of the channel cover 190 therein. In some embodiments, as seen in FIG. 3, the notches 255 may have a rectangular profile. In other embodiments, the notches 255 may have other profiles, such as triangular, rounded, and the like. In other embodiments (not shown), instead of notches and protrusions, any other inter-engageable components may be provided between the first channel 70 and the channel cover 190.

The mount post 20 of FIG. 4 differs from that of FIG. 3, in that the notches 255 have a L-shaped profile. Further, in the embodiment of FIG. 4, the side walls 200 of the first channel 70 further comprises a second step 265 formed in the channel base portion 220 further reducing the channel base width 230 compared to the channel mouth width 250.

Turning now to FIG. 5, the support stud 160 will be described in further detail. The support stud 160 is configured to be connected to the mount post 20 and comprises a support surface (also referred to as channel) 270 for supporting the rail 180 and/or a panel extending transversely from the mount post 20. The support stud 160 comprises a support stud body 280 having a tail portion 290 and a head portion 300, giving the support stud 160 a T-shaped profile. The support stud 160 is configured to be inserted in the first channel 70 with the tail portion 290 first, such that a front face 310 of the head portion 300 faces outwardly from the first channel 70. The support surface 270 is transverse to the front face 310.

The support stud 160 includes one or more bores (also referred to as holes) which extend from the front face 310 of the head portion 300 towards the tail portion 290 for receiving one or more respective fasteners. In use, each bore is sized and shaped so that the fastener extends through the bore and one end of the fastener protrudes from the tail portion 290 to engage with the side wall, or a corresponding bore extending from side wall of the respective channel in which it is received (e.g. side walls 200 of the first channel 70). For example, FIG. 3 illustrates bores extending from the side wall of the first channel each of which is configured to receive a respective fastener extending from the support stud.

In the embodiment of FIG. 5, the support stud 160 comprises a first bore 320 and a second bore 330 which are divergent as they extend from the head portion 300 to the tail portion 290 of the support stud 160. The first bore 320 may be angled at about 45 degrees from a central axis 340 of the support stud 160 in one direction, and the second bore 330 may be angled at about 45 degrees from the central axis 340 in another direction. In other embodiments, the first and second bores 320, 330 may be divergent at any angle from about 15 degrees to about 90 degrees from the central axis in opposite directions from one another.

The support stud 160 further comprises a third bore 350, also extending from the tail portion 290 to the head portion 300 and positioned between the first bore 320 and the second bore 330. The third bore extends parallel to the central axis 340 of the support stud 160. Each bore of the first, second and third bores 320, 330, 350 extends from a first open bore end 360 at the head portion 300 to a second open bore end 370 at the tail portion 290. Each of the bores 320, 330, 350 are sized and shaped to receive a fastener, such that the fastener extends through the bores and beyond the second open bore end 370 into the first channel 70 to connect the support stud 160 to the mount post 20. The fastener may comprise a screw, or a nail. In certain embodiments, the first bore and the second bore are divergent from each other, the central axis 340 and the third bore 350 as they extend from the head portion 300 towards the tail portion 290 of the support stud 160. The first and second bores 320, 330 may form an angle of about 45 degrees respectively from the central axis 340.

In other embodiments, the support stud 160 may comprise only a first bore. In other embodiments, the support stud 160 may comprise a first bore and a second bore disposed at any orientation with respect to one another, or the central axis 340 of the support stud 160 as they extend from the head portion 300 to the tail portion 290 such that their respective second open bore ends 370 are spaced apart from another at the tail portion.

The front face 310 of the head portion 300 has an inset portion (or cavity) 380 defined by an inset wall 390. In these embodiments, the first open bore end 360 is defined in the inset wall 390. The inset wall 390 may have angled portions defining a geometric shape within the inset portion 380 of the front face 310. As seen in FIG. 5, the inset wall 390 has five angled portions with respect to one another. The angled portions can be considered as faces. The first open bore end 360 of each bore is formed in a respective one of the angled portions. As seen in FIG. 5, in certain embodiments, the respective first open ends 360 of the first, second and third bores 320, 330, 350 are on respective adjacent faces of the inset wall 390.

In other embodiments (not shown), the inset wall 390 may comprise less than five sides or more than five sides angled with respect to one another, for example, three sides. In further embodiments, the inset wall 390 may be curvilinear (not shown), with the first open bore end 360 extending from any angle with respect to the central axis 240 of the support stud 160. In further embodiments, the front face 310 of the head portion 300 may instead comprise a flat surface (without an inset portion) on which the first open bore end 360 will be defined.

Figure 6C:
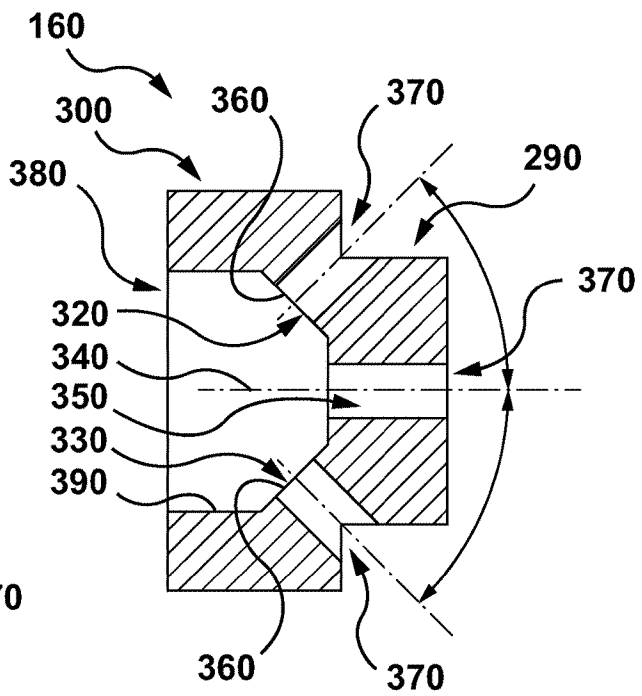
FIG. 6C illustrates a cross-sectional view through lines A-A' of the support stud of FIG. 6B.
Figure 6B:
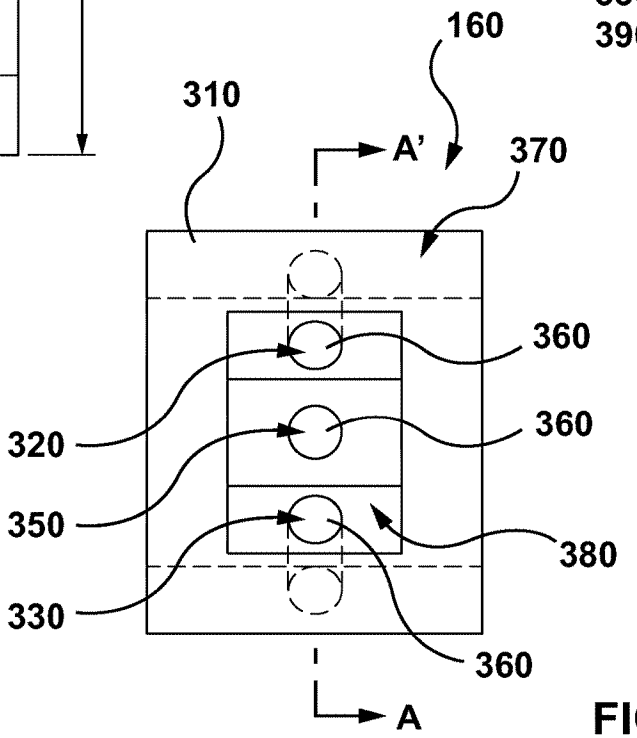
FIGS. 6A and 6B illustrate a top view and a front view, respectively, of an alternative embodiment of the support stud of FIG. 5A, according to certain embodiments of the present technology.
Figure 6A:
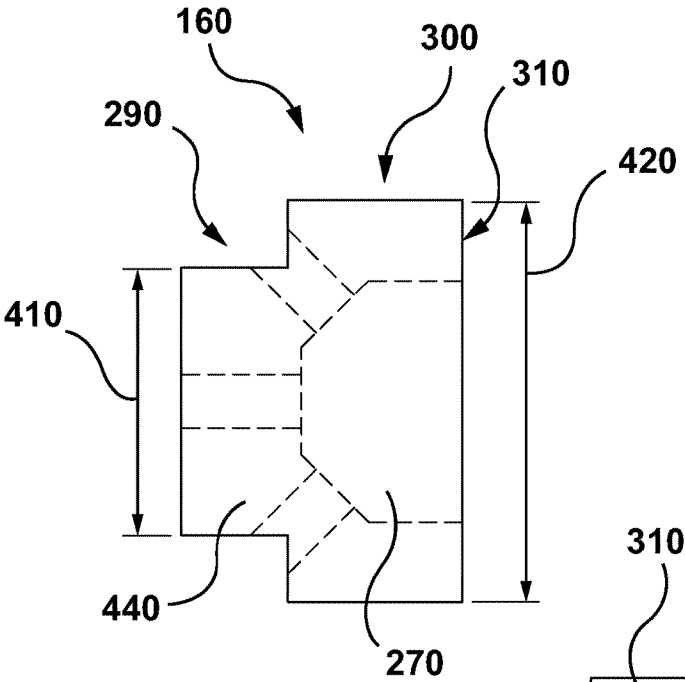
Figure 7C:
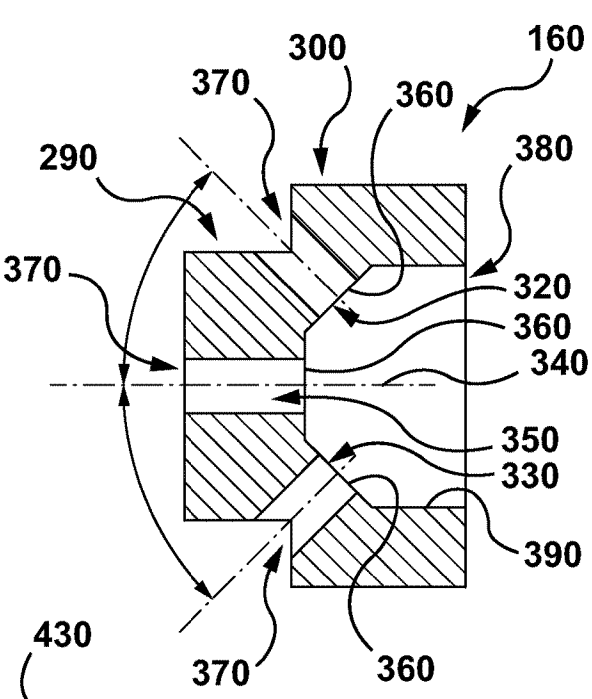
FIG. 7C illustrates a cross-sectional view through lines B-B' of the support stud of FIG. 7B.
Figure 7B:
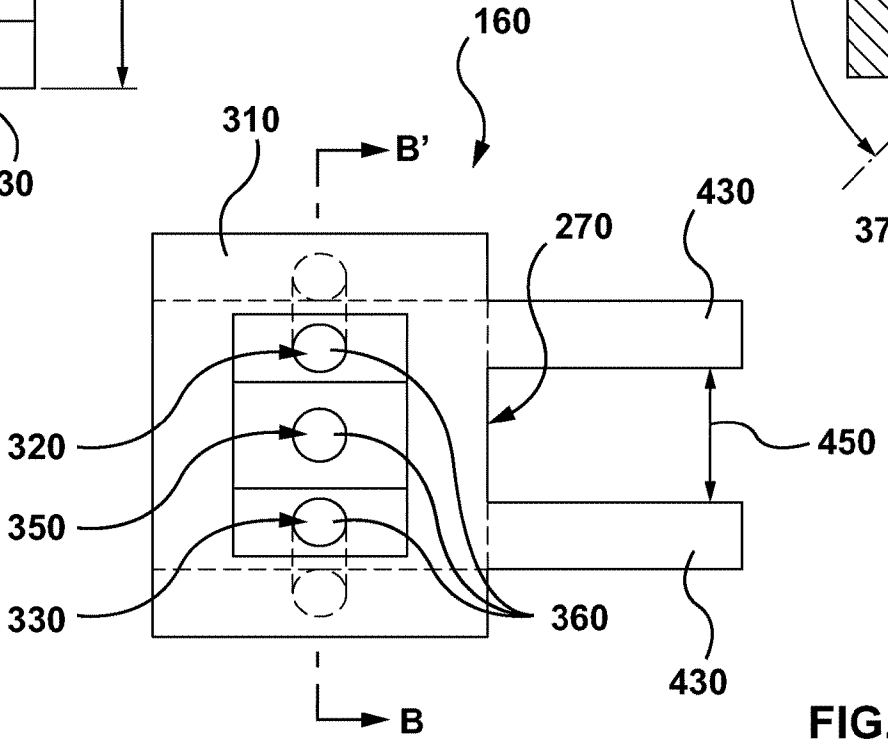
FIGS. 7A and 7B illustrate a top view, and a front view, respectively, of an alternative embodiment of the support stud of FIG. 5A, according to certain embodiments of the present technology.
Figure 7A:
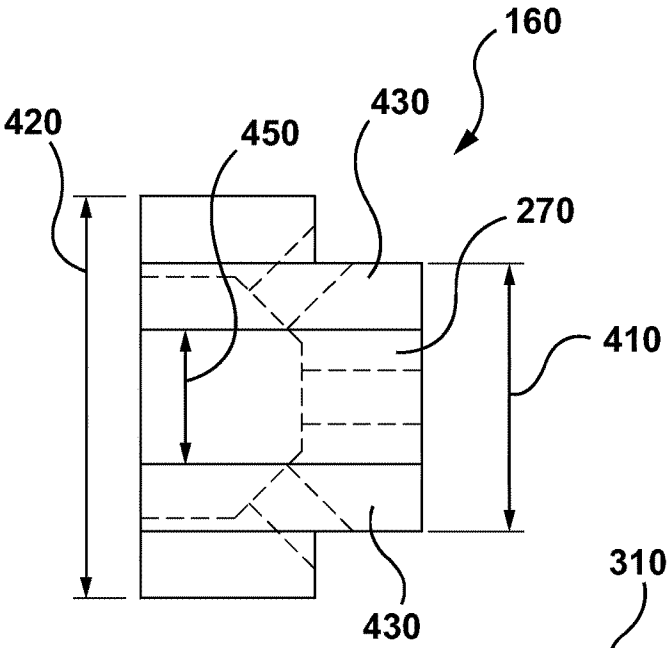
Figure 8C:
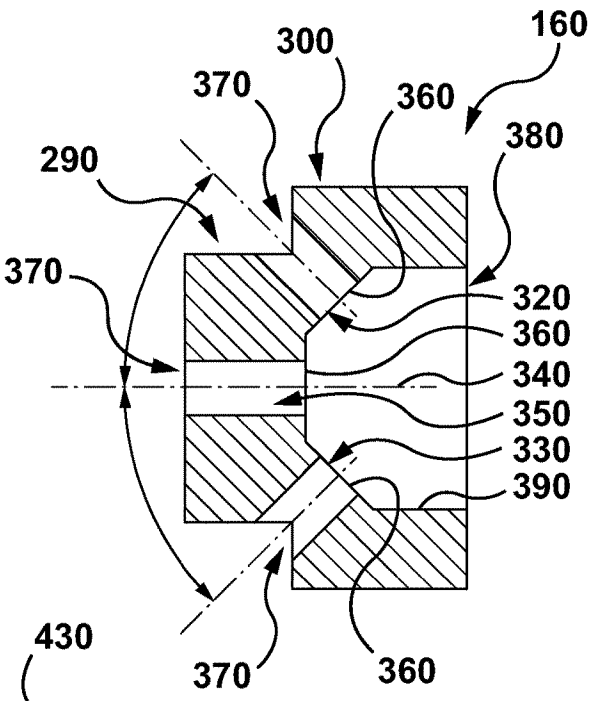
FIG. 8C illustrates a cross-sectional view through lines C-C' of the support stud of FIG. 8B.
Figure 8B:
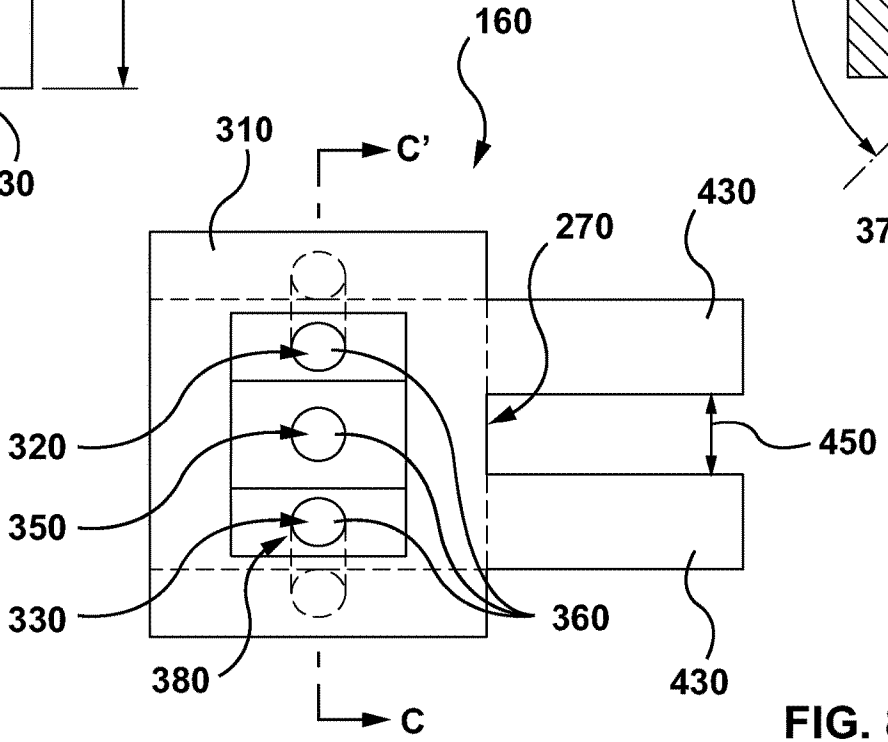
FIGS. 8A and 8B illustrate a top view and a front view, respectively, of an alternative embodiment of the support stud of FIG. 5A.
Figure 8A:
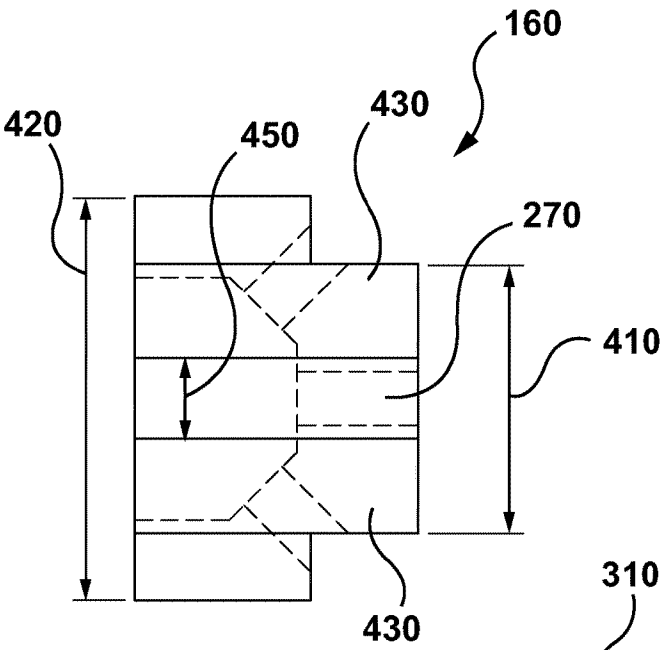

Still referring to FIG. 5, the second bore open end 370 is defined at a posterior face 400 of the head portion 300. In other embodiments, such as seen in FIGS. 6, 7 and 8 the second bore open end 370 may be positioned at a junction of the tail portion 290 and the head portion 300. In yet further embodiments, the second bore open end 370 may be positioned at a side wall of the head portion 300 (not shown).

The tail portion 290 of the support stud 160 has a tail portion width 410 which is less than the channel base width 230, such that the tail portion 290 can extend into the channel base portion 220 of the first channel 70 (and equally the second and third channels 90, 100, in certain embodiments). The head portion 300 of the support stud 160 has a head portion width 420 which is wider than the channel base width 230 such that the head portion 300 abuts against the step 210 and can not be received in the channel base portion 220. The dimensions of the channel base width 230 and channel mouth width 250 of the mount post 20 may be varied according to the size of the mount post 20 and size of rail and/or panel to be used. A dimension of the tail portion width 410 and head portion width 420 may therefore be selected according to the dimensions of the channel base width 230 in the mount post 20 being used, such as to ensure that the tail portion 290 can extend into the channel base portion 220 of the first channel 70 and the head portion 300 can rest on the step, and is not received in the channel base portion 220.

In certain embodiments, the channel base width 230 may be between about 15 mm to about 25 mm, or between about 20 mm to about 25 mm. In other embodiments, the channel base width 230 may be about 24 mm. In further embodiments, the channel base width 230 may be about 21 mm. In yet other embodiments, the channel mouth width 250 may be between about 26 mm to about 45 mm or between about 35 mm to about 40 mm. In further embodiments, the channel mouth width 250 may be about 39 mm. In certain implementations of these embodiments, the tail portion width 410 of the support stud 160 may be between about 14 mm to about 24 mm, or between about 18 mm to about 22 mm. In one implementation of these embodiments, the tail portion width 410 may be about 20 mm. In yet other implementation of these embodiments, the head portion width 420 of the support stud may be between about 26 mm to about 45 mm, or between about 28 mm to about 32 mm. In another implementation of these embodiments, the head portion width 420 may be about 30 mm.

Figure 5A:
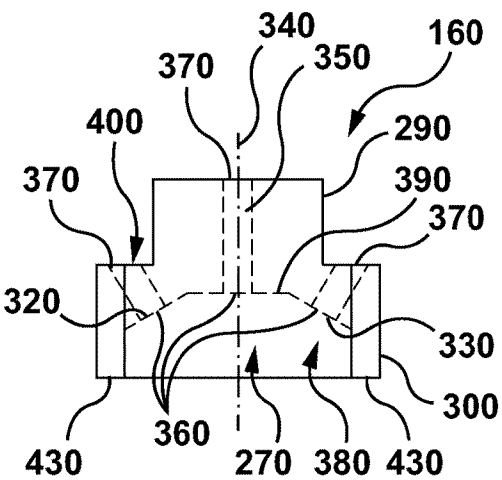
FIGS. 5A and 5B illustrate a top view and a front view, respectively, of the support stud of FIG. 1.
Figure 5C:
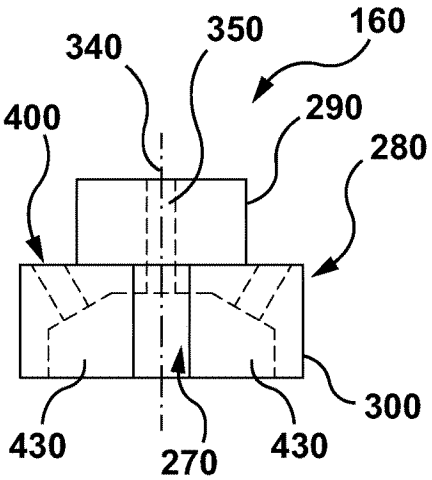
FIGS. 5C and 5D illustrate a top view and a front view, respectively, of an alternative embodiment of the support stud of FIG. 5A, according to certain embodiments of the present technology.
Figure 5E:
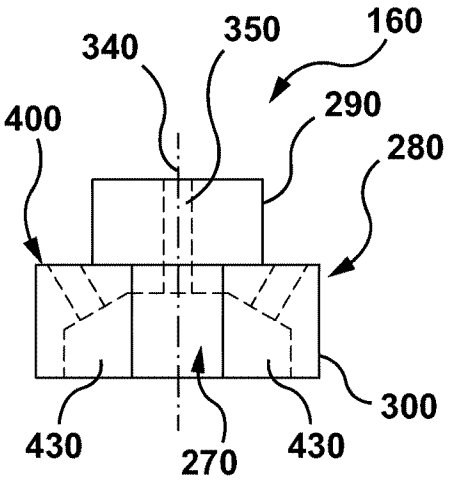
FIGS. 5E and 5F illustrate a top view and a front view, respectively, of a further embodiment of the support stud of FIG. 5A, according to certain embodiments of the present technology.
Figure 5B:
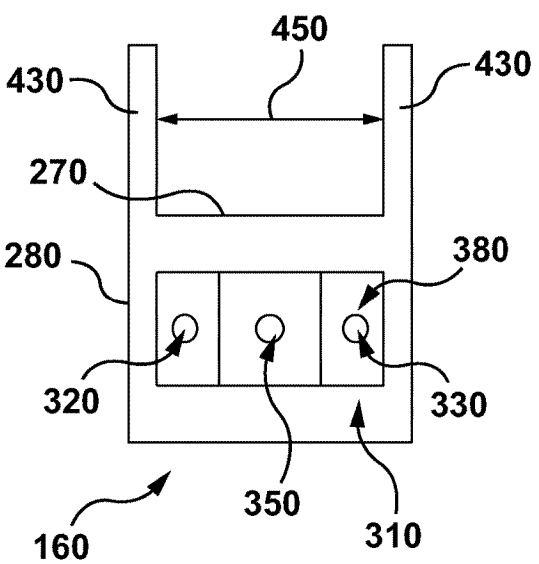
Figure 5D:
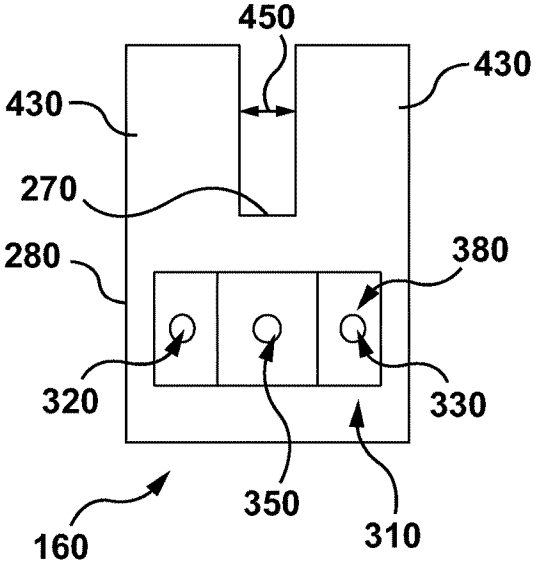
Figure 5F:
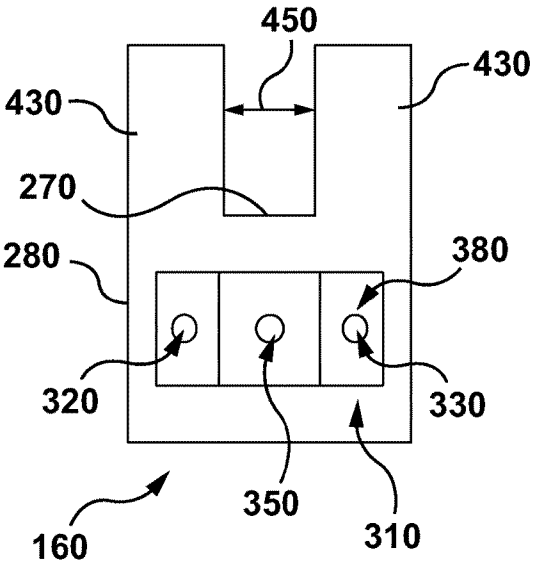

As best seen in FIG. 5B, the support stud 160 further comprises a pair of arms 430 extending upwardly from the support surface 270 of the support stud 160. The pair of arms 430 and the support surface 270 defines a channel for receiving a panel and thereby attaching a panel to the mount post 20. The pair of arms 430 are spaced apart from one another, one on either side of the support surface 270 by a width 450 of the support surface 270. The width 450 of the support surface 270, or the spacing of the pair of arms 430 may therefore be selected according to a width of a panel to be attached thereto. As can be seen, in the embodiments of the support stud 160 of FIGS. 5A and 5B, the width 450 is larger than in the embodiments of the support stud 160 of FIGS. 5C and 5D, as well as 5E and 5F.

The embodiment of the support stud 160 in FIGS. 6-8 differs from that of FIG. 5 in that there are no arms extending from the support surface 270. In the absence of the arms 430, as seen in the embodiment of FIG. 6, a top face of the support stud 440 (transverse to the front face 310 and extending from head portion 300 to tail portion 290) defines the support surface 270.

In certain embodiments, the width 450 of the support surface 270 may be between about 5 mm to about 35 mm, or about 5 mm to about 15 mm. In one embodiment, the width of the support surface 450 is about 10 mm. In another embodiment, the width of the support surface 450 is about 6 mm. It will be understood that in embodiments wherein the arms 430 are absent the width of the support surface 450 would be equivalent to the head portion width 420 as disclosed above.

Figure 9A:
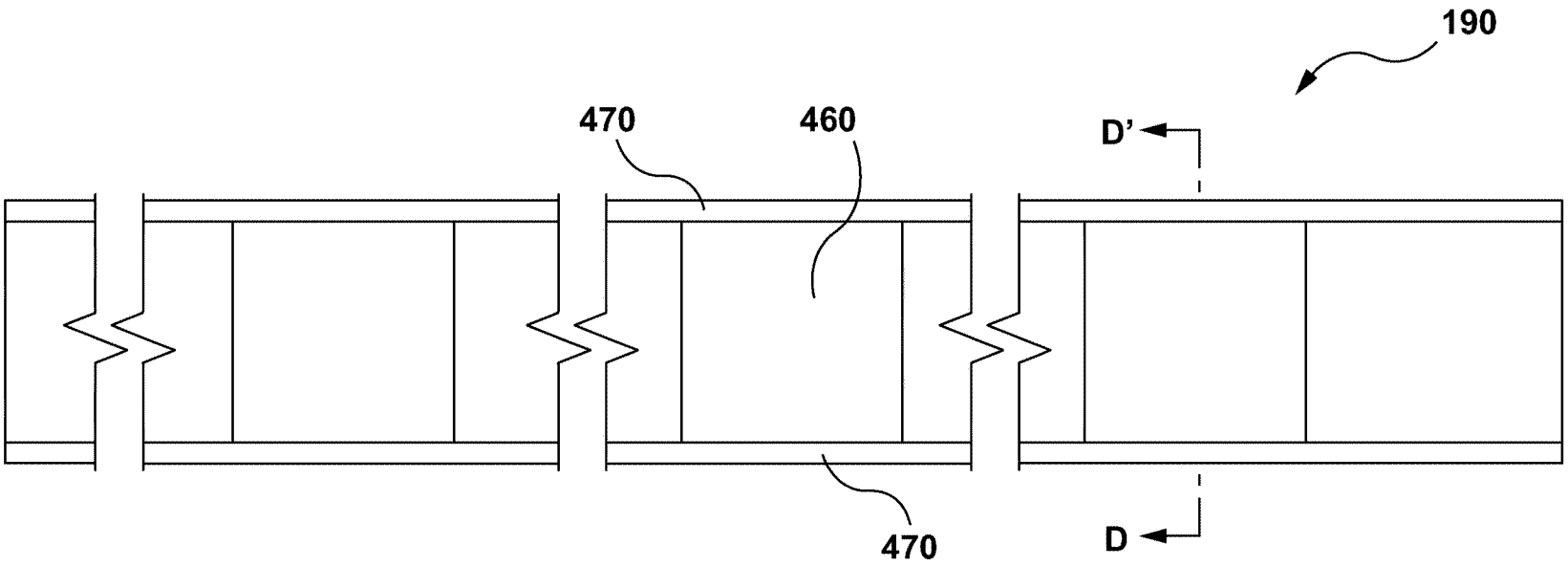
FIG. 9A illustrates a plan view of one of the channel covers of FIG. 1, according to certain embodiments of the present technology.
Figure 9B:
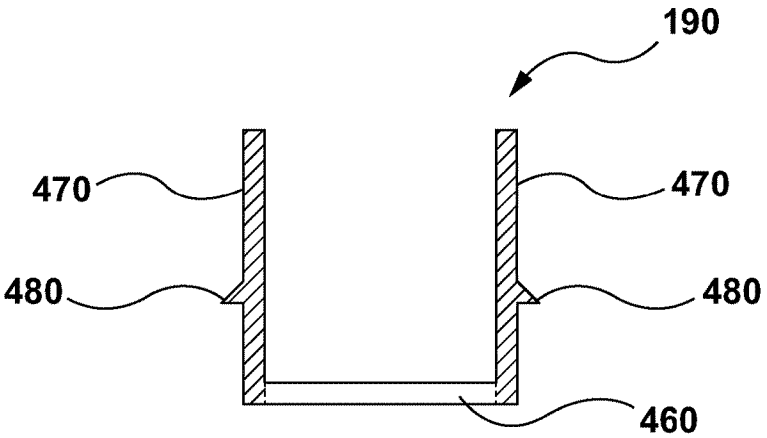
FIG. 9B illustrates a cross-sectional view through lines D-D' of the channel cover of FIG. 9A.

Referring now to FIG. 9, the channel cover 190 of FIGS. 1 and 2 will be described in further detail. The channel cover 190 comprises a channel cover body 460 sized and shaped to cover any of the first, second and third channels 70, 90, 100, and a pair of channel cover arms 470. Each of the channel cover arms 470 extends transversely from a respective side of the channel cover body 460 and is configured to be received in the first channel 70. Each channel cover arm 470 comprises a protrusion 480 extending outwardly therefrom (such as transversely with respect to the arm) and is configured to be received in the notch 255 defined by the side wall 200 of the first channel 70. The protrusion 480 may be of any size and shape which is complementary to the notch 255 such as to provide a secure attachment of channel cover 190 to the first channel 70. In the embodiment, of FIG. 9, the protrusion 480 has a triangular profile. In other embodiments, however, the protrusion 480 may have a rectangular or an L-shaped profile. Instead of the protrusion 480 and notch 255, any other inter-engageable features may be provided on the side wall 200 of the first channel 70 and the channel cover arm 470.

A length of the channel cover 190 corresponds to a length of the first channel 70 extending between the base end 50 and the top end 60 of the mount post 20. In other embodiments (not shown), the length of the channel cover 190 may be adjusted (for example the channel cover 190 may be cut) to cover portions of the first channel 70 which remain exposed/open following attachment of the support stud 160 and the rail 180 to the first channel 70 in use.

Figure 10B:
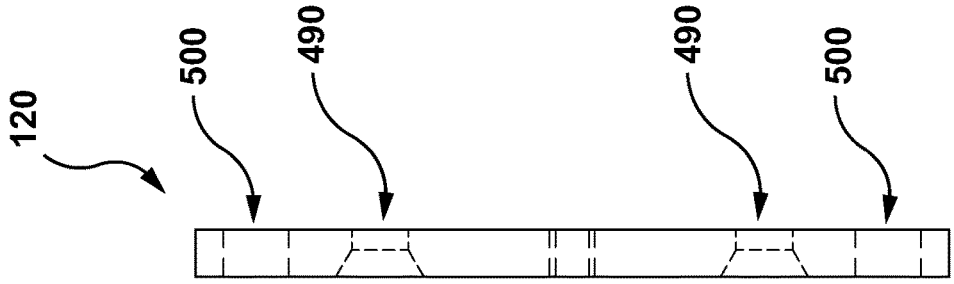
FIGS. 10A and 10B illustrate a plan view and a side view, respectively, of the mount post base plate of FIG. 1, according to certain embodiments of the present technology.
Figure 10A:
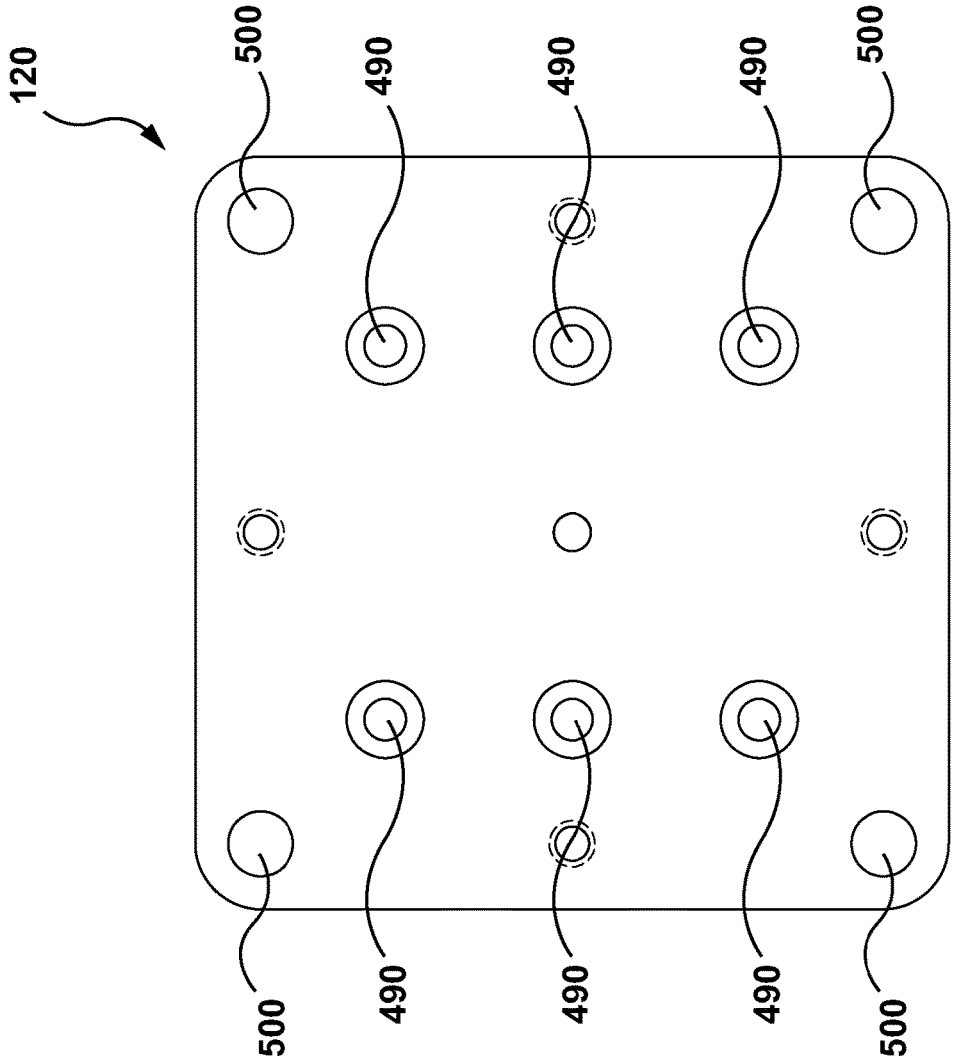

Referring now to FIG. 10, there is shown an embodiment of the mount post base plate 120 of FIG. 1, which can be attached to the base end 50 of the mount post 20. The mount post base plate 120 has base plate openings 490 formed therein through which fasteners 115 can be extended to attach to the mount post 20. As discussed above, the mount post 20 receives each of the fasteners 115 in the respective aperture 110. In other embodiments, the mount post base plate 120 may comprise protrusions (not shown), instead of the base plate opening 490, configured to be received in apertures 110, the protrusions being of any size and shape complementary to the apertures 110.

In the illustrated embodiments, the mount post base plate 120 has a larger surface area than the base end 50 of the mount post 20 and therefore extends beyond the mount post 20. In such embodiments, the openings 490 for attachment to the mount post 20 may be inner openings, there being provided outer openings 500 through which fasteners can be extended to attach the mount post base plate 120, and hence the mount post 20, to a support surface. The inner openings 490 can be in a quadrilateral configuration and correspond with corners of the mount post 20 when the mount post is four-sided. In other embodiments, the mount post base plate 120 may have a larger surface area than the base end 50 of the mount post 20 but may not comprise said outer openings 500. In such embodiments, other attachment mechanisms readily known in the arts, such as nails, staples, or protrusions extending from a lower surface of the mount post base plate 120 may be used to attach the mount post base plate 120 to a support surface. In yet other embodiments, the mount post base plate 120 may have substantially the same surface area as the base end 50 of the mount post 20.

Figure 11B:
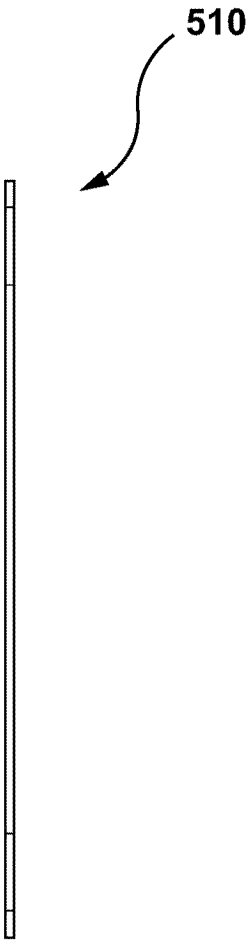
FIGS. 11A and 11B illustrate a plan view and a side view, respectively, of a base rim component for use with the mount post base plate of FIG. 10A, according to certain embodiments of the present technology.
Figure 11A:
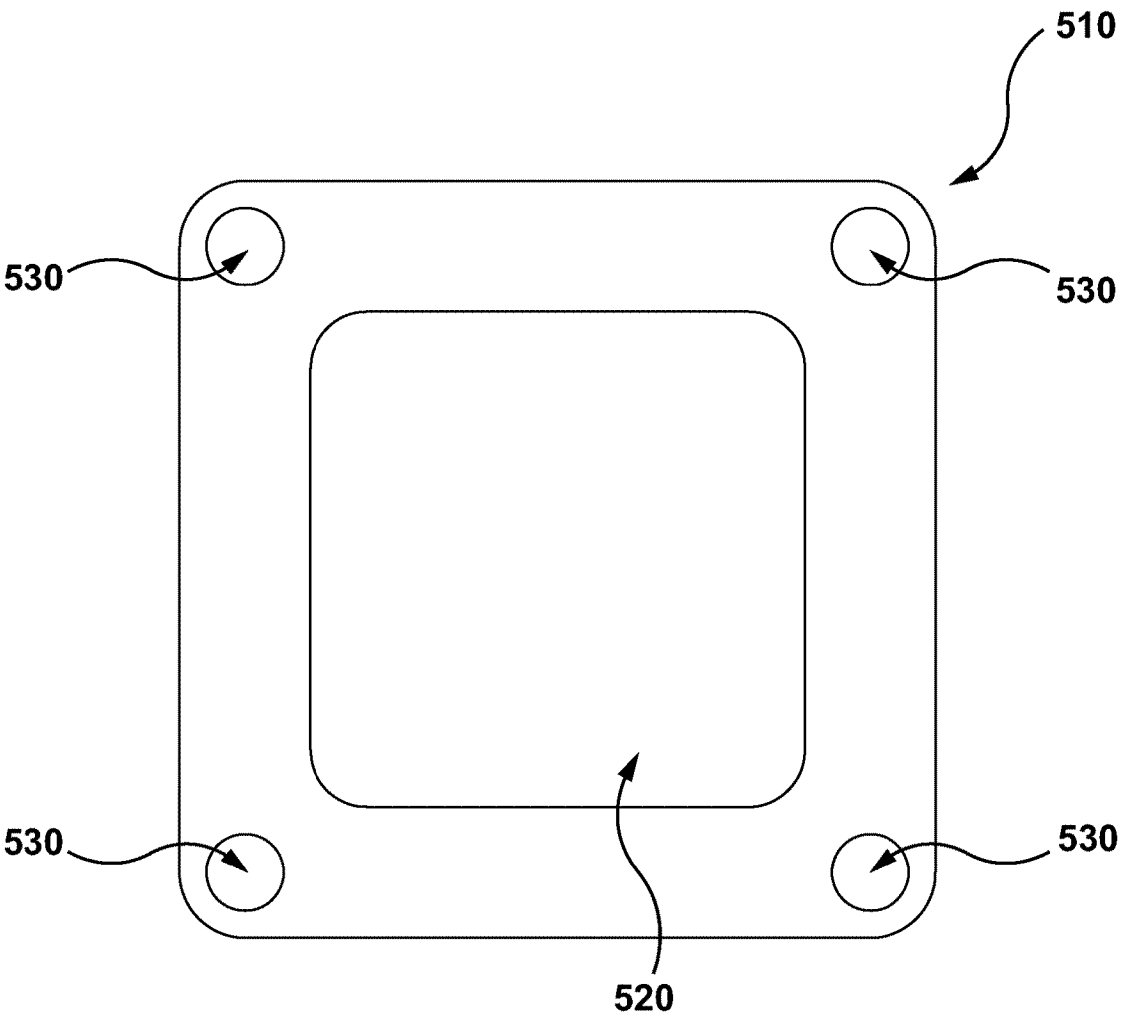

Referring to FIG. 11, in certain embodiments, the fence assembly 10 includes a base rim component 510 to attach the mount post 20 to a support surface. The base rim component 510 comprises a central opening 520 formed therein for the mount post 20 to be received and comprises additional openings 530 at its periphery for fasteners to extend therethrough and attach the base rim component 510, and hence the mount post 20 to a support surface. As discussed above, it will be understood that any attachment mechanism known in the art may be used to replace said openings 530 and attach the base rim component 510 to the support surface.

Figure 12B:
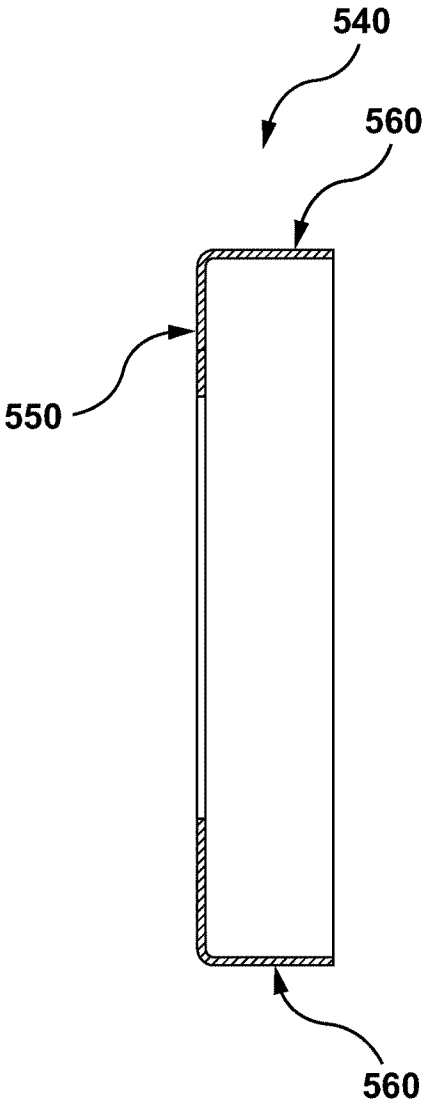
FIGS. 12A and 12B illustrate a plan view and a cross-sectional view through lines E-E', respectively, of a base rim cover for use with the mount post base plate of FIG. 10A, according to certain embodiments of the present technology.
Figure 12A:
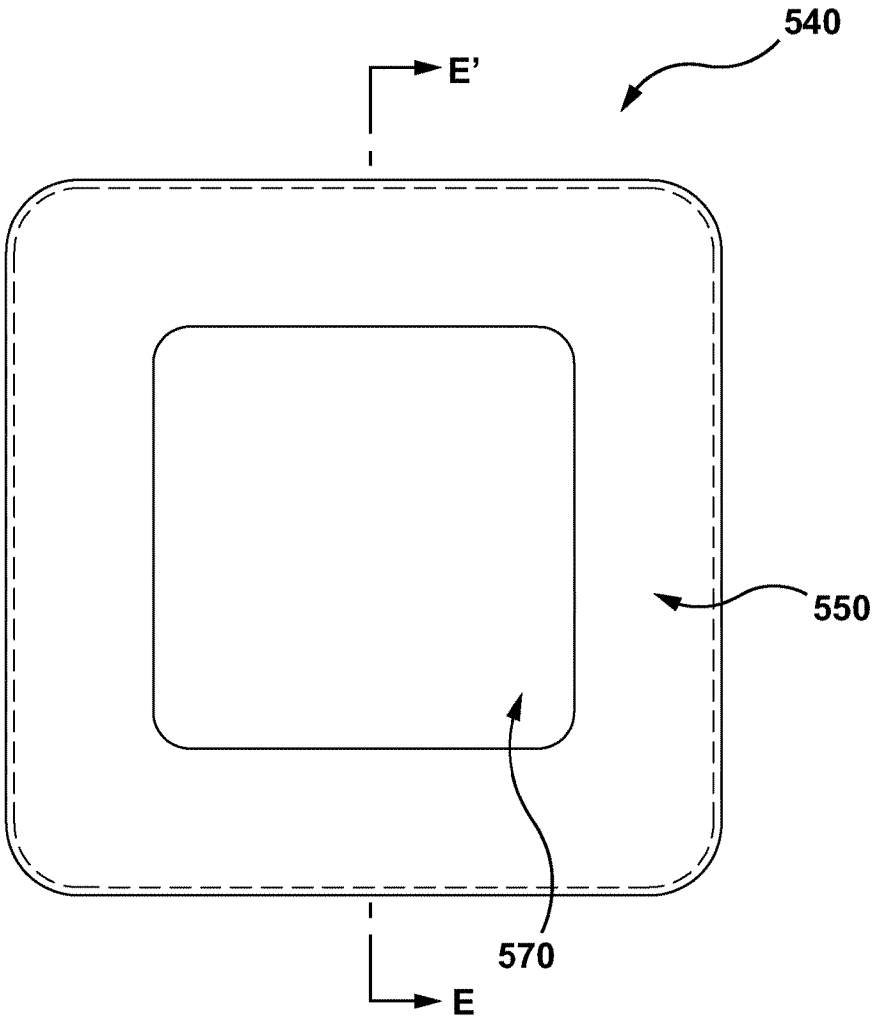

Referring to FIG. 12, in certain embodiments, the fence assembly 10 includes a base rim cover 540 for covering the base rim component 510. The base rim cover 540 has an outer face 550 and a skirt 560 for placing over the base rim component 510. The base rim cover 540 has a central opening 570 that lines up with the central opening 520 of the base rim component 510 and is sized and shaped to receive the mount post 20 therein.

Figure 13B:
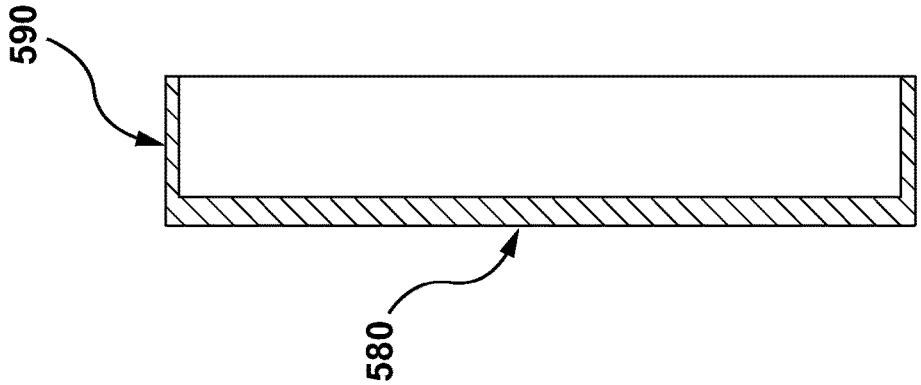
FIGS. 13A and 13B illustrate a plan view and a cross-sectional view through lines F-F', respectively, of a mount post top cover for use with the mount post of FIG. 1 or the mount post of FIG. 4, according to certain embodiments of the present technology.
Figure 13A:
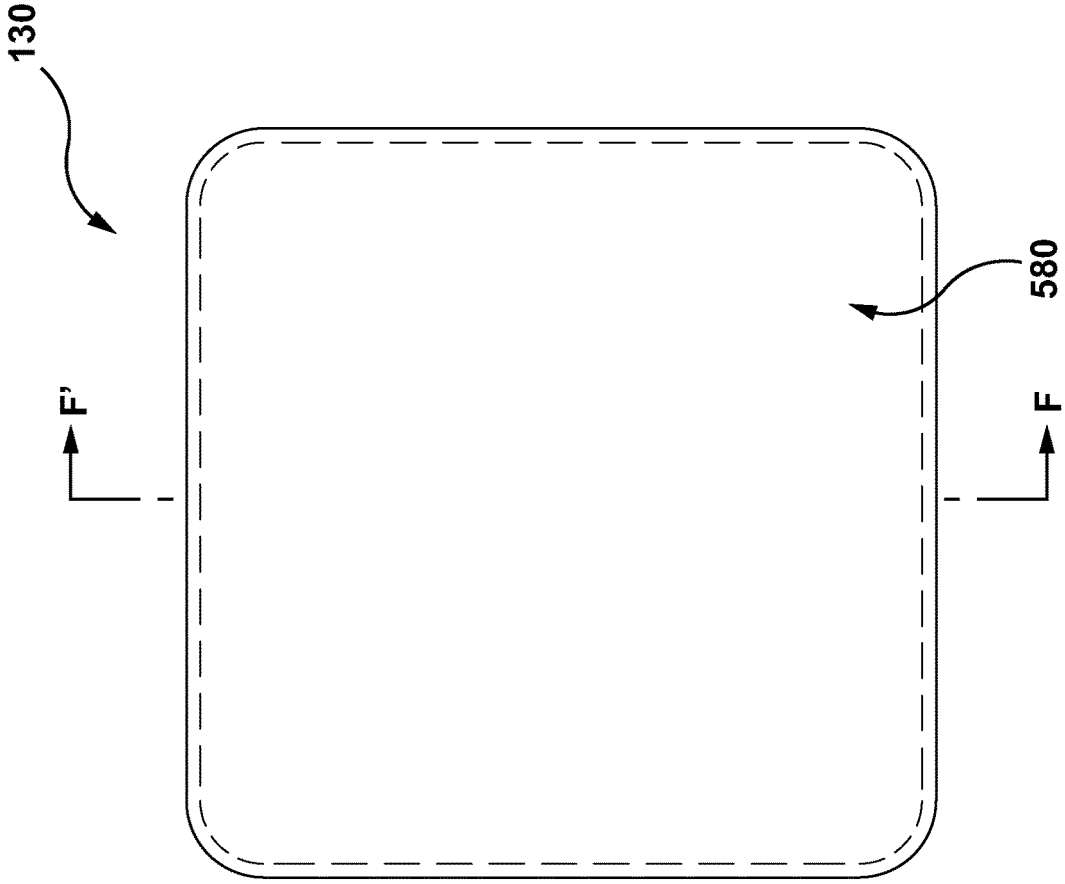

In certain embodiments, as discussed above, the fence assembly 10 may include the mount post top cover 130 sized and shaped to cover the top end 60 of the mount post 20. As seen in FIGS. 1, 2, the mount post top cover 130, comprises a top cover rim 140 which covers the top end 60 and the apertures 110 of the mount post 20. The top cover rim 140 comprises a top face 580 and a skirt 590 for placing over the top end 60 of the mount post 20 and a central opening 600. The mount post top cover 130 in these embodiments may further comprise a top cover central component (also referred to as a top cap) 150 being sized and shaped to line up and fit in the central opening 600. In other embodiments, as illustrated in FIG. 13, the mount post top cover 130 may comprise a continuous top face 580 (without a central opening) for covering the top end 60 of the mount post 20.

It will be understood that the mount post base plate 120, the base rim component 510, the central opening 520, and/or the mount post top cover 130 may have any size and shape suitable to support and/or cover the mount post 20. In certain embodiments, as presented in FIGS. 1-4, and 10-13, the mount post 20 is four sided, as such the mount post base plate 120, the base rim component 510, the central opening 520, and the mount post top cover 130 have a four sided shape. In other embodiments, however, the mount post 20 may have any number of sides, such as three sides, five sides, six sides, eight sides, or be of any other suitable shape. In such embodiments, the mount post base plate 120, the base rim component 510, the central opening 520, and the mount post top cover 130 may be configured to have a shape corresponding to the cross-sectional profile of the mount post 20.

Figures 14A, 14B:
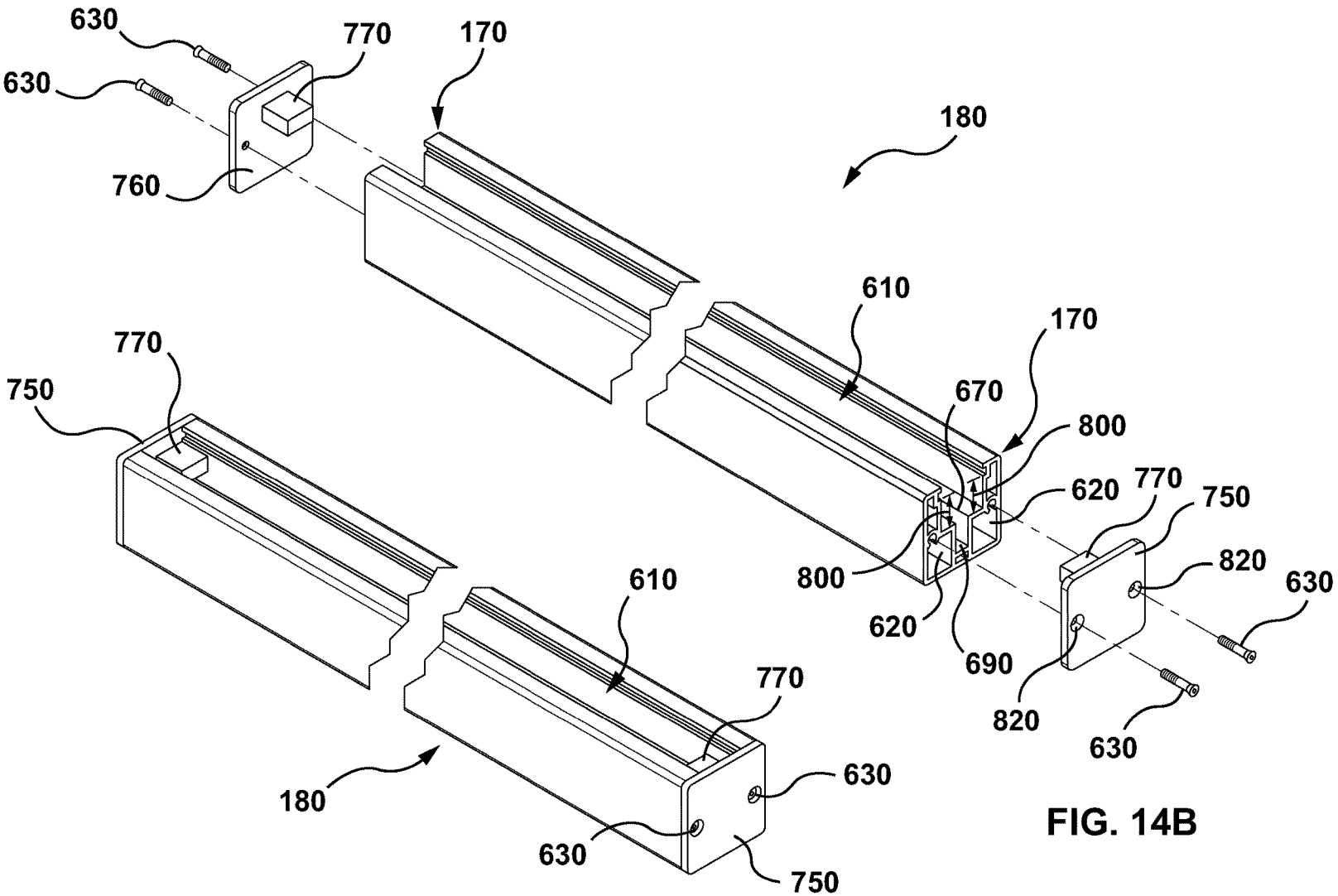
FIG. 14A illustrates a perspective view of the rail of FIG. 1 with rail covers, according to certain embodiments of the present technology.
FIG. 14B illustrates an exploded view of the rail of FIG. 14A.

Referring now to FIGS. 14A and B, embodiments of the rail 180 of FIG. 1 will be described in further detail. The rail 180 comprises two free ends 170, each free end 170 being sized and shaped to be received in the first channel 70. Equally, to the extent that the second and third channels 90, 100 have the same size and shape as the first channel 70, the free ends 170 of the rail 180 can also be received in the second and third channels 90, 100 of the mount post 20.

In the embodiments illustrated herein, the rail 180 has an elongate body with four-side, with one of the four sides having a rail channel 610 formed therein. The rail channel 610 extends between the two free ends 170 of the rail 180. The rail channel 610 may be configured to receive a panel, such as a wood panel, a glass panel and the like, to create a solid fence.

It will be understood that the shape of the rail 180 may be varied according to a desired function or esthetic outcome. Furthermore, in embodiments wherein a solid fence is not desired (i.e., panels are not used), the rail channel 180 may be omitted in the rail. Alternatively, the rail 180 may comprise a plurality of rail channels 610 formed therein, the plurality of rail channels 610 being circumferentially space apart from one another to be able to receive multiple panels. By way of example, in certain embodiments wherein the rail 180 is four sided, opposing sides of the rail 180 may each comprise a rail channel 610 formed therein.

The rail 180 in these embodiments is hollow and comprises rail apertures 620 extending therethrough. Some of the rail apertures 620 are sized and shaped to receive a fastener 630 therewith, such as a pin, a tab or a protrusion. Other of the rail apertures 620 may help to minimize material used without compromising the mechanical properties of the rail. It will be understood that the rail apertures 620 can have any suitable form and shape, and can differ from the configurations illustrated.

Figure 15A:
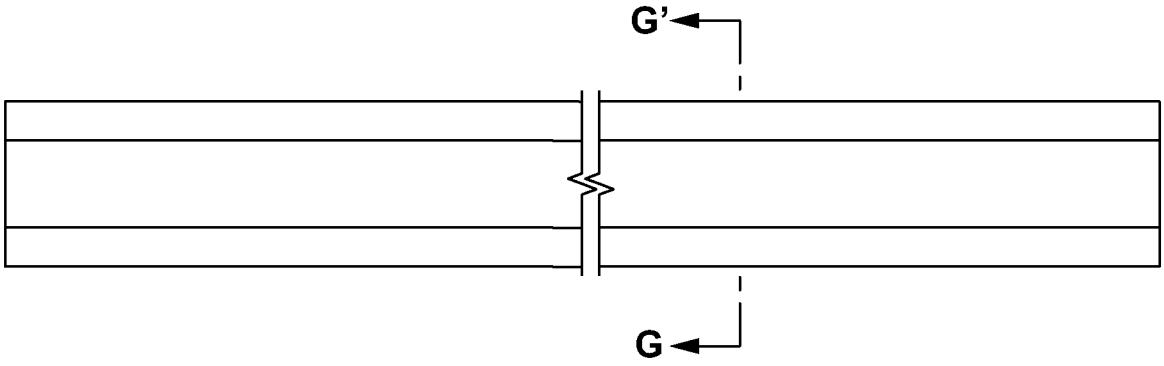
FIG. 15A illustrates a plan view of one of the rails of FIG. 1, according to certain embodiments of the present technology.
Figure 15B:
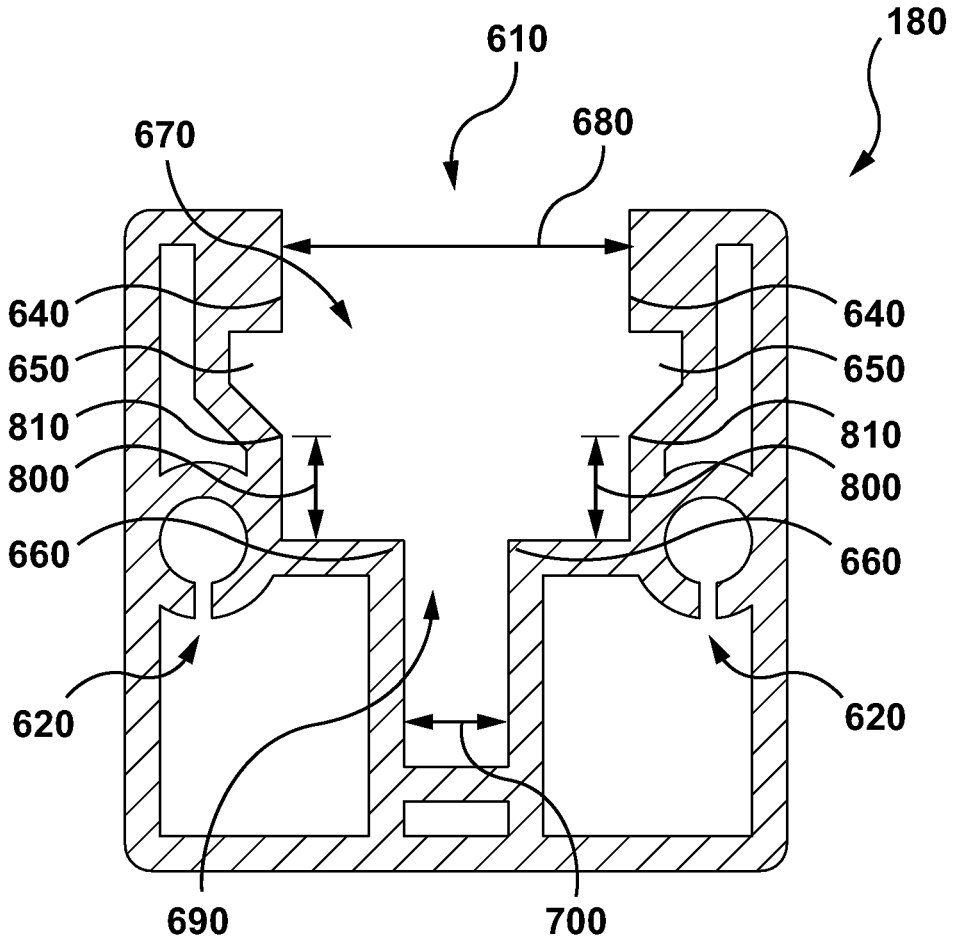
FIG. 15B illustrates a cross-sectional view through lines G-G' of the rail of FIG. 15A.

FIGS. 15A and B, illustrates the rail 180 in greater detail. The rail channel 610 is defined by side walls 640 which have a respective rail channel notch 650 formed therein for receiving and securing a rail channel cover (also referred to as a rail cover) 655, as will be described in further detail below. Side walls 640 further comprise a rail channel step 660 formed therein which define a rail channel mouth portion 670 having a rail channel mouth width 680, and a rail channel base portion 690 having a rail channel base portion width 700 for securing the panel therein. The rail channel base portion width 700 may be selected according to a width of the panel to be used.

Figure 2:
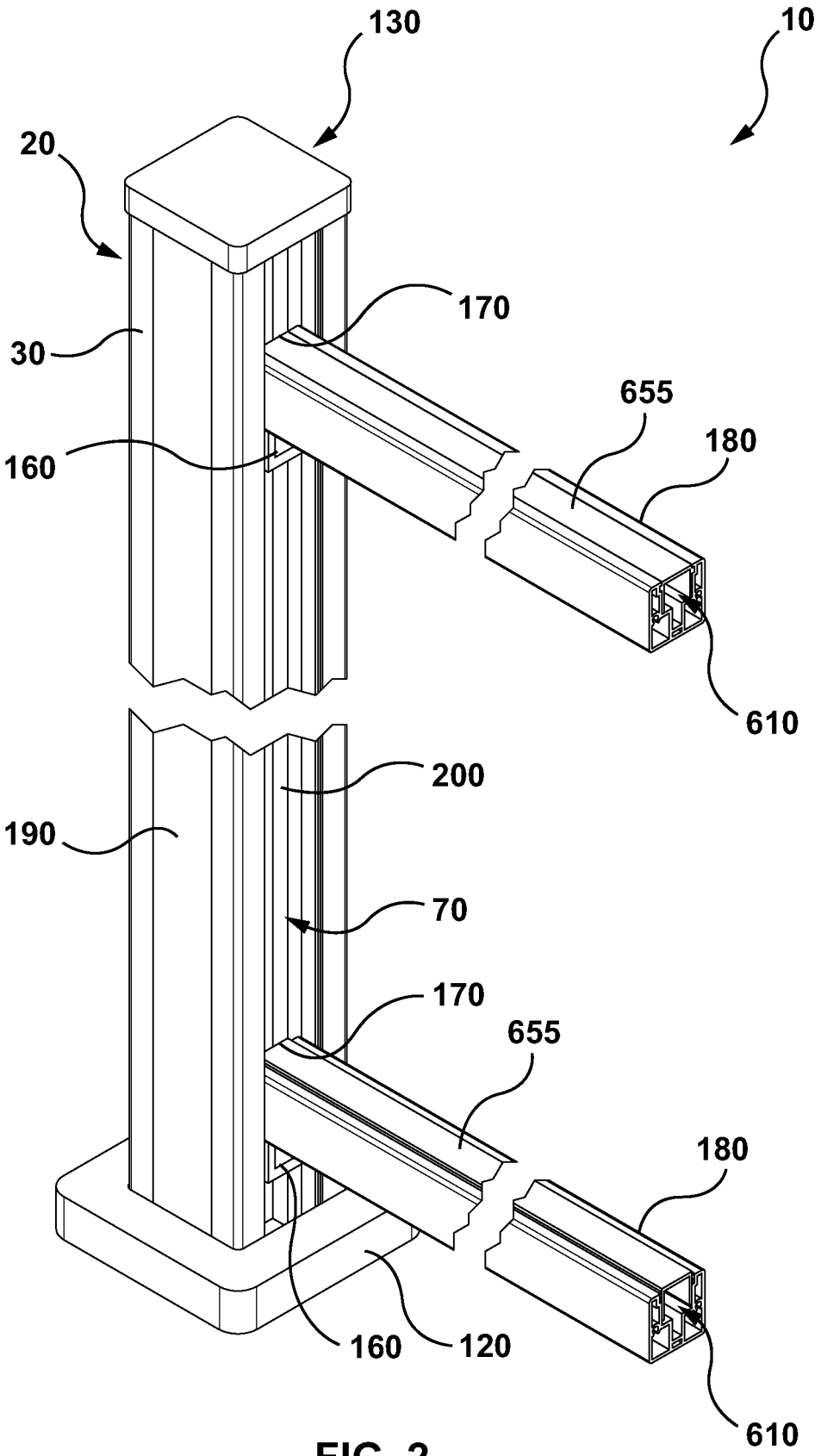
FIG. 2 illustrates a perspective view of the fence assembly of FIG. 1.
Figure 16B:
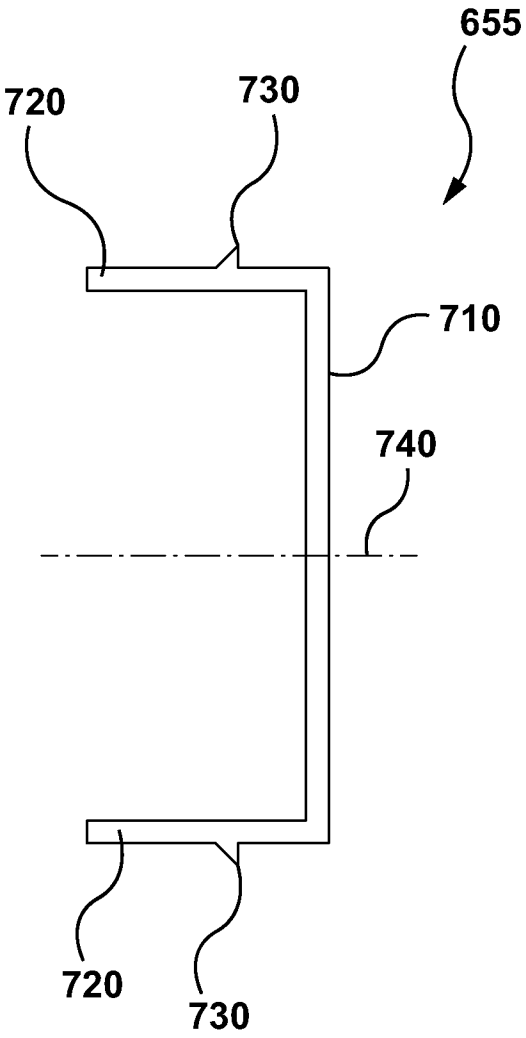
FIGS. 16A and 16B illustrate a plan view and a side view, respectively, of the rail channel cover of FIG. 1, according to certain embodiments of the present technology.
Figure 16A:
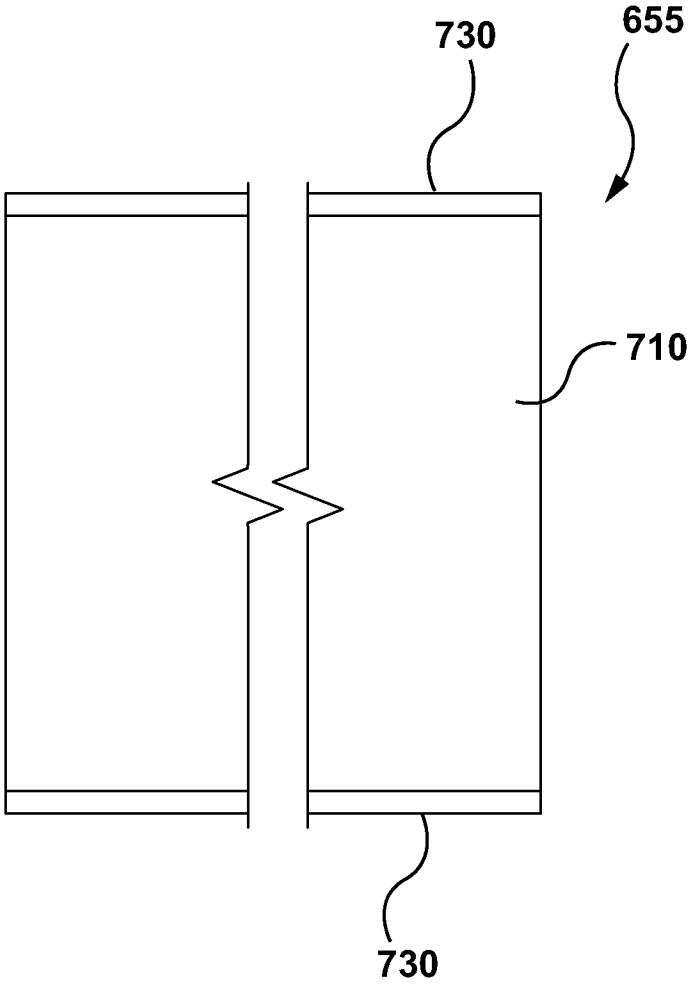
Figure 17B:
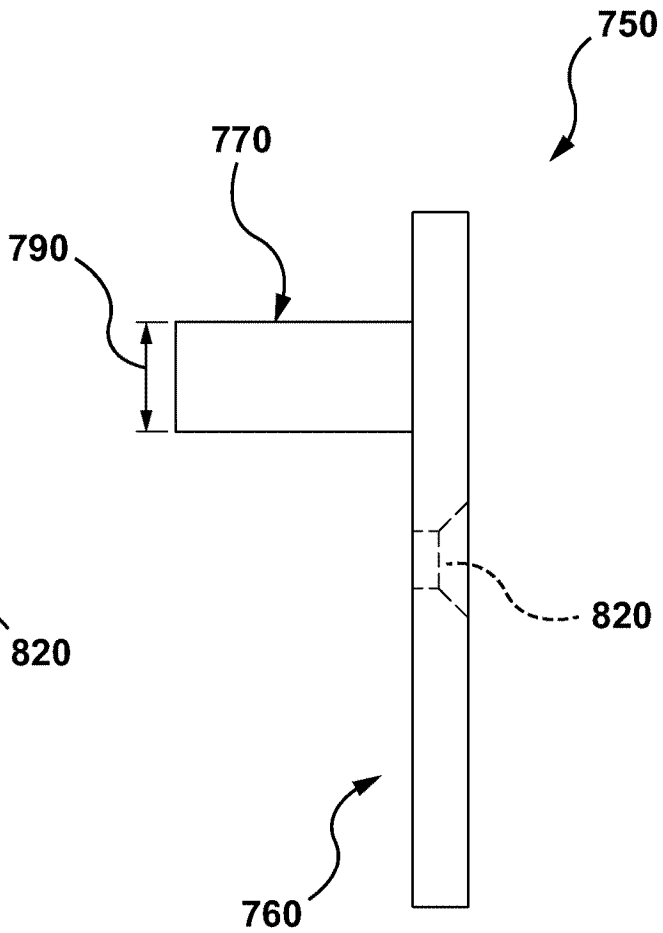
FIGS. 17A and 17B illustrate plan and side views, respectively, of a rail end cover for use with the rails of FIG. 1, according to certain embodiments of the present technology.
Figure 17A:
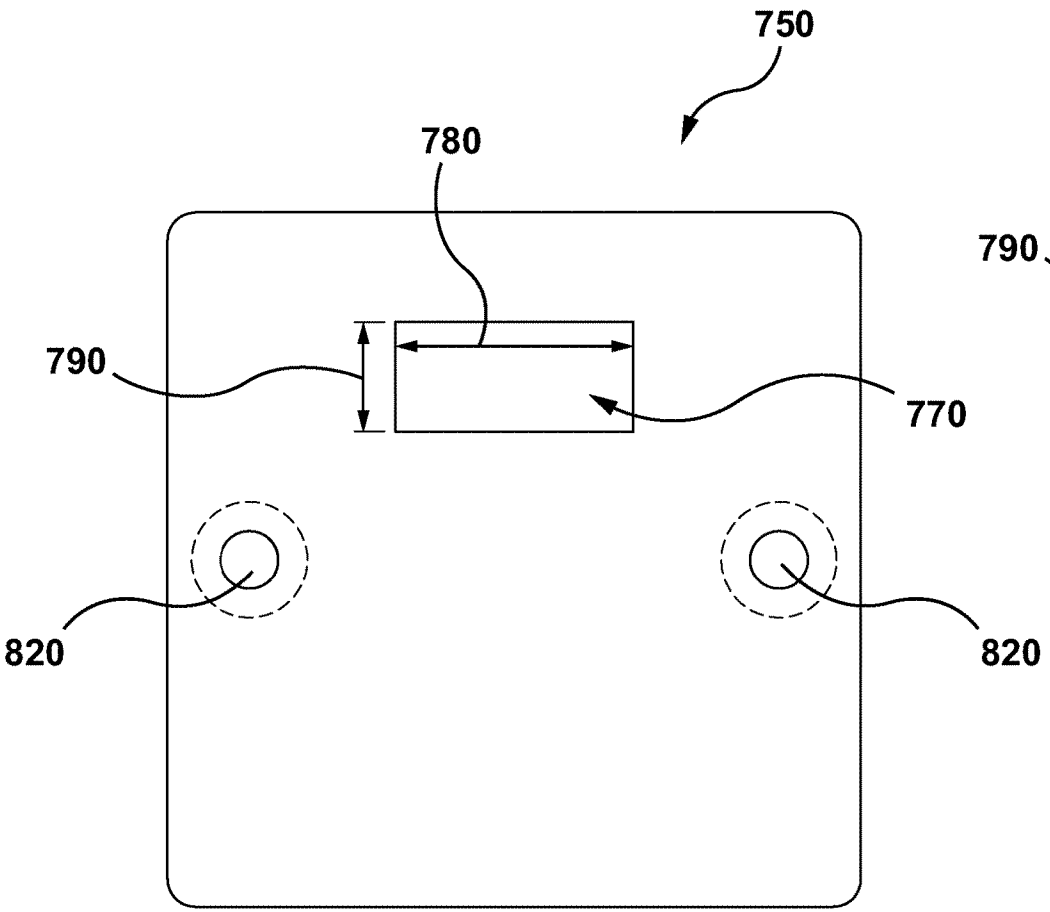

In certain embodiments, as best seen in FIGS. 1 and 2, the fence assembly 10 may be provided with the rail channel cover 655 for covering the rail channel 610. Referring now to FIG. 16, the rail channel cover 655 has a rail channel cover body 710 which is sized and shaped to cover the rail channel 610 and a pair of rail channel cover arms 720, each channel cover arm 720 extending transversely from a respective side of the rail channel cover body 710 and configured to be received in the rail channel 160. In certain embodiments, each rail channel cover arm 720 further comprises a protrusion 730 extending transversely therefrom configured to be received in the rail channel notch 650. The protrusion 730 and the rail channel notch 650 may have any profile sized and shaped to be complementary with one another such as to provide a secure attachment of rail channel cover 655 to the rail channel 610. In other embodiments (not shown), instead of the protrusion 730 and the rail channel notch 650, any other inter-engageable features may be provided on the side wall 640 of the rail channel 610 and the rail channel cover arm 720. For example, the side walls 640 of the rail channel 610 may define a protrusion, instead of notch 650, configured to be received in a corresponding notch formed the rail channel cover arm 720. To specify, in such embodiments, each rail channel cover arm 720 would comprise a notch extending transversely towards a central axis 740 of the rail channel cover 655, instead of the protrusion 730. Is it understood, that the rail cover arm 720 in this embodiments would have a sufficient width to provide for a notch having a sufficient depth to secure said protrusion formed in the side wall 640 of the rail channel 610 therein.

In certain embodiments, as seen in FIGS. 14A and 14B, a rail end cover (also referred to as end cap) 750 may be provided for covering one of the free ends 170 of the rail 180. In these embodiments, the rail end cover 750 is four-sided and corresponds substantially to the cross-sectional shape of the rail 180. Rail end cover 750 comprises an inner face 760 and a protrusion 770 extending from the inner face 760 and configured to be received in the free end 170 of the rail 180. In these embodiments, the protrusion 770 extending from the inner face 760 of the rail end cover 750 is sized and shaped in accordance with the dimensions of the rail channel mouth portion 670 (as seen in FIGS. 14A, 14B, 17A and 17B) such as to be secured in the rail channel mouth portion 670 of the rail channel 610. In certain embodiments, therefore, the protrusion may have a width 780 sized in accordance with the rail channel mouth portion width 680 and a height 790 sized in accordance to a distance 800 defined by a lower end 810 of rail channel notch 650 and rail channel step 660. In other embodiments, the protrusion 770 may be sized and shaped to be received in one or more of the rail apertures 620 at the free end 170 of the rail 180.

As seen in FIGS. 14A, 14B, 17A and 17B, the rail end cover 750 comprises two openings 820 for fasteners 630 to extend therethrough and into corresponding rail apertures 620. In other embodiments, rail end cover 750 may comprise one or more than two openings 820. How the rail end cover 750 may be attached to the rail 180 is not limited, and in other embodiments, the rail end cover 750 may comprise one of opening 820 or protrusion 770 to secure the rail end cover 750 to the free end 170 of the rail 180.

Figure 18B:
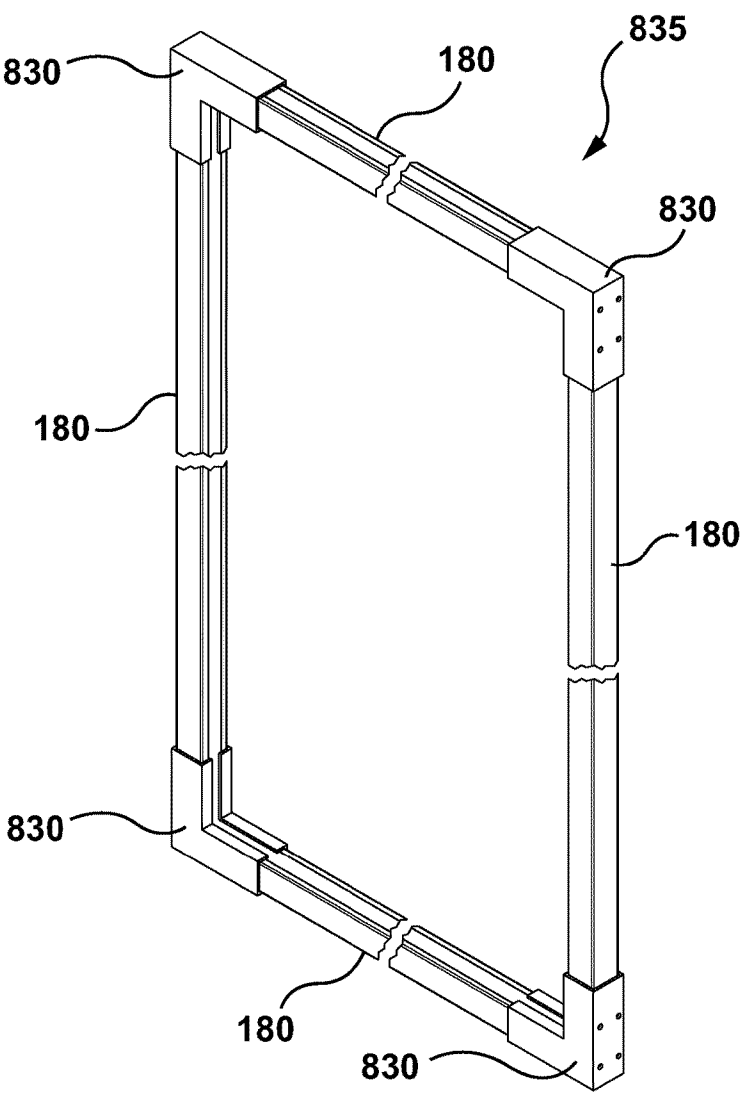
FIG. 18B illustrates an exploded view of the frame assembly of FIG. 18A.
Figure 18A:
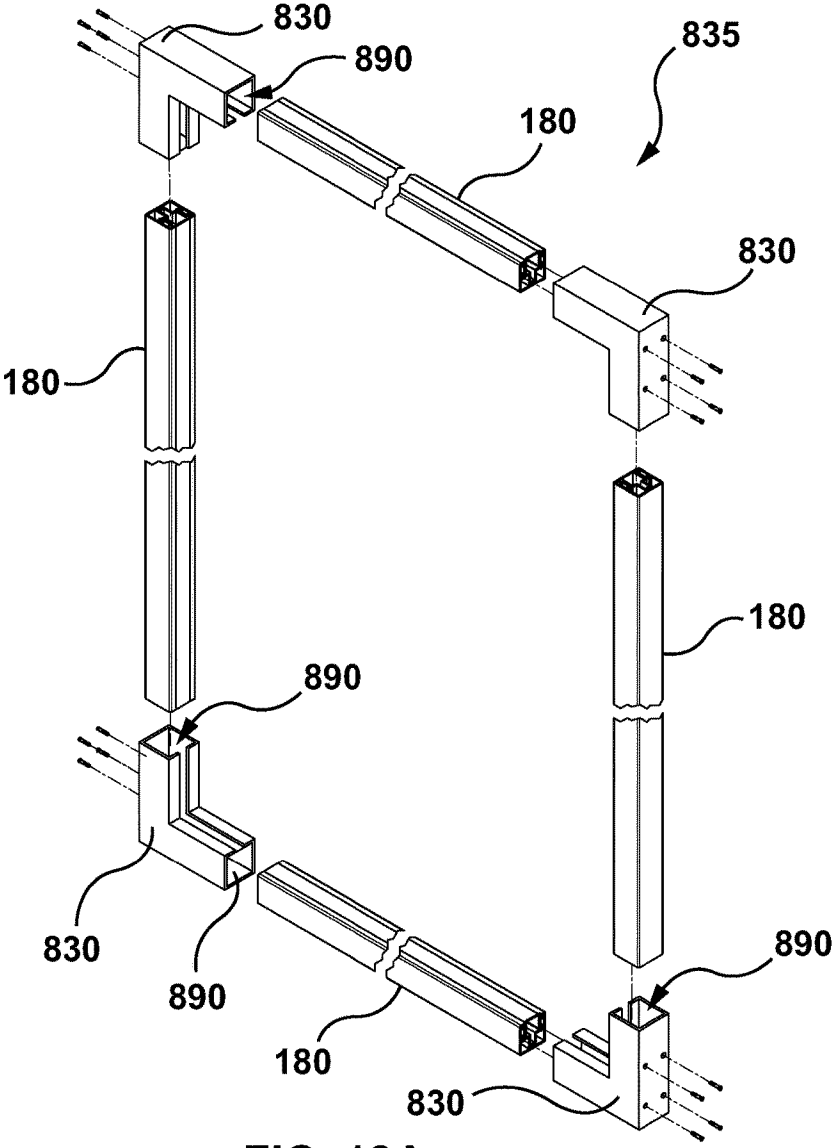
FIG. 18A illustrates a perspective view of a frame assembly including the rail of FIG. 1, according to certain embodiments of the present technology.
Figure 19C:
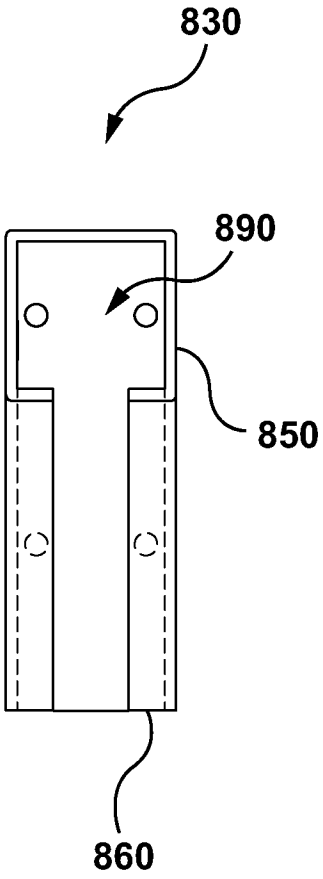
FIG. 19C illustrates a front view of the L connector of FIG. 19A.
Figure 19B:
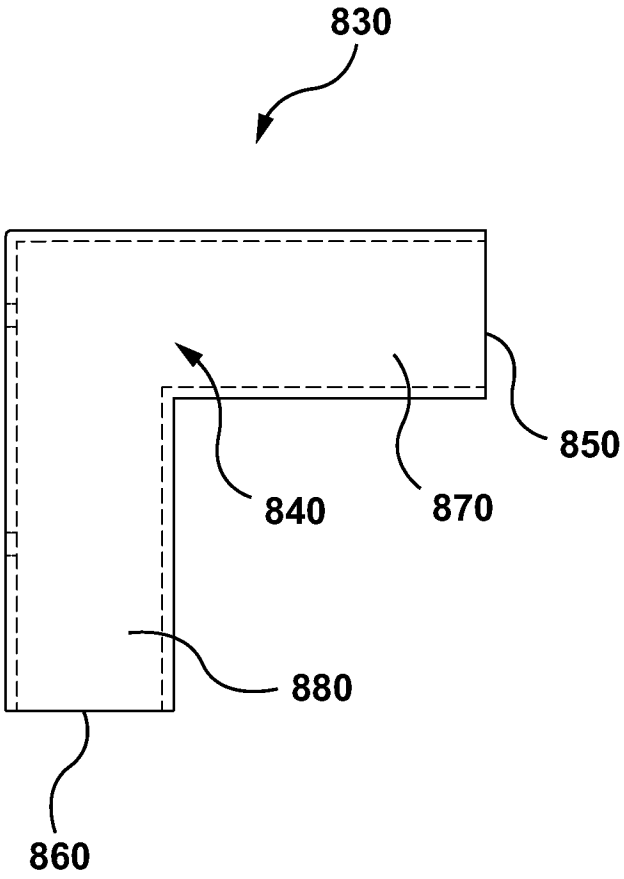
FIG. 19B illustrates a side view of the L connector of FIG. 19A.
Figure 19A:
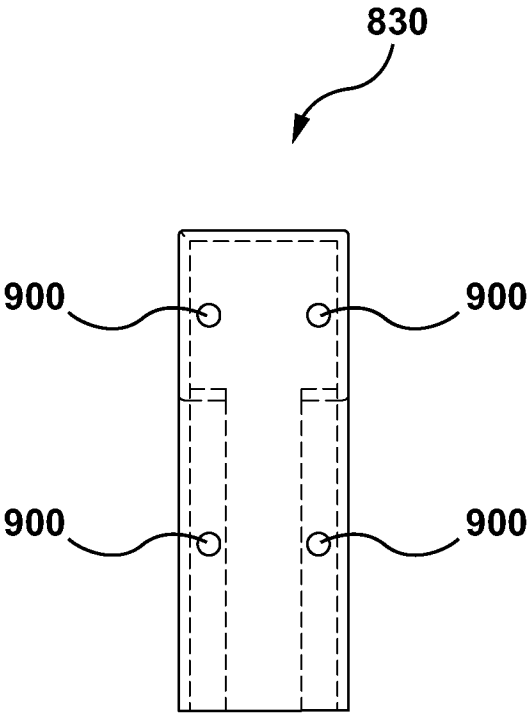
FIG. 19A illustrates a back view of a L connector according to certain embodiments of the present technology.

In other embodiments, as best seen in FIGS. 18A and 18B, a plurality of the rails 180 may be connected to one another by a L connector (also referred to as angled member) 830 to provide a frame assembly (also referred to as framework) 835 for a panel. In this embodiment, four rails 180 are connected to one another by L connectors 830. Each L connector 830 is configured to engage two rails 180. As best in seen FIGS. 19A-19C the L connector 830 comprises a body 840 having a first end 850 and second end 860. The body 840 is L-shaped and therefore comprises a first portion 870, and a second portion 880 extending in a direction generally transverse to the first portion 870. The L connector is generally hollow and comprises a cavity 890 extending from the first end 860 to the second end 860. The first end 860 is configured to receive a first free end 170 of a first rail 180, and the second end 860 is configured to receive a first free end 170 of a second rail 180. Cavity 890 is sized and shaped in accordance with the size and shape of the first end 170 of the rail 180. As seen in FIGS. 18A, 18B, and 19A-19C, the cavity 890 has a four-sided profile complementary to the profile of the four-sided rail 180, and covers a portion of the outer surface of the rail 180 when the first end 170 of the rail 180 is received therein. The body 840 of the L connector 830 may further comprise at least two openings 900 for receiving fasteners therethrough which extend into rail apertures 620 and secure the L connector 830 to the rails 180. Additional openings 900 may be provided along the body of the L connector to further secure the L connector to the rails 180.

Figure 20B:
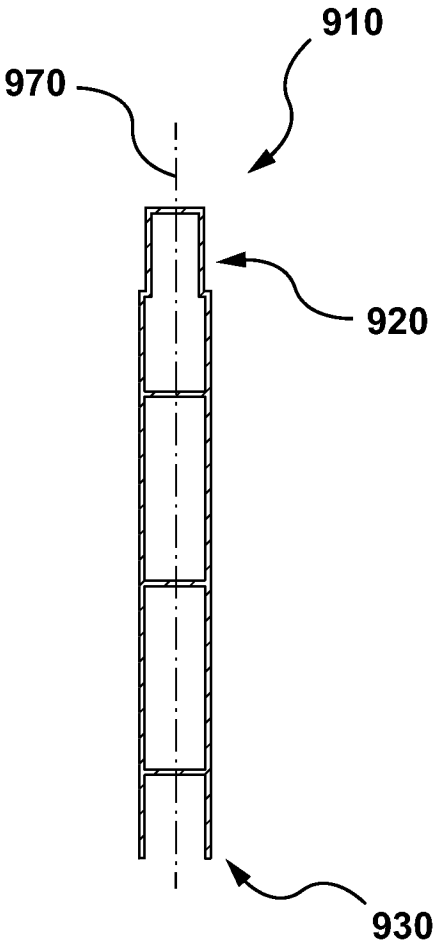
FIG. 20B illustrates a cross-sectional view through the line H-H' of the panel of FIG. 20A.
Figure 20A:
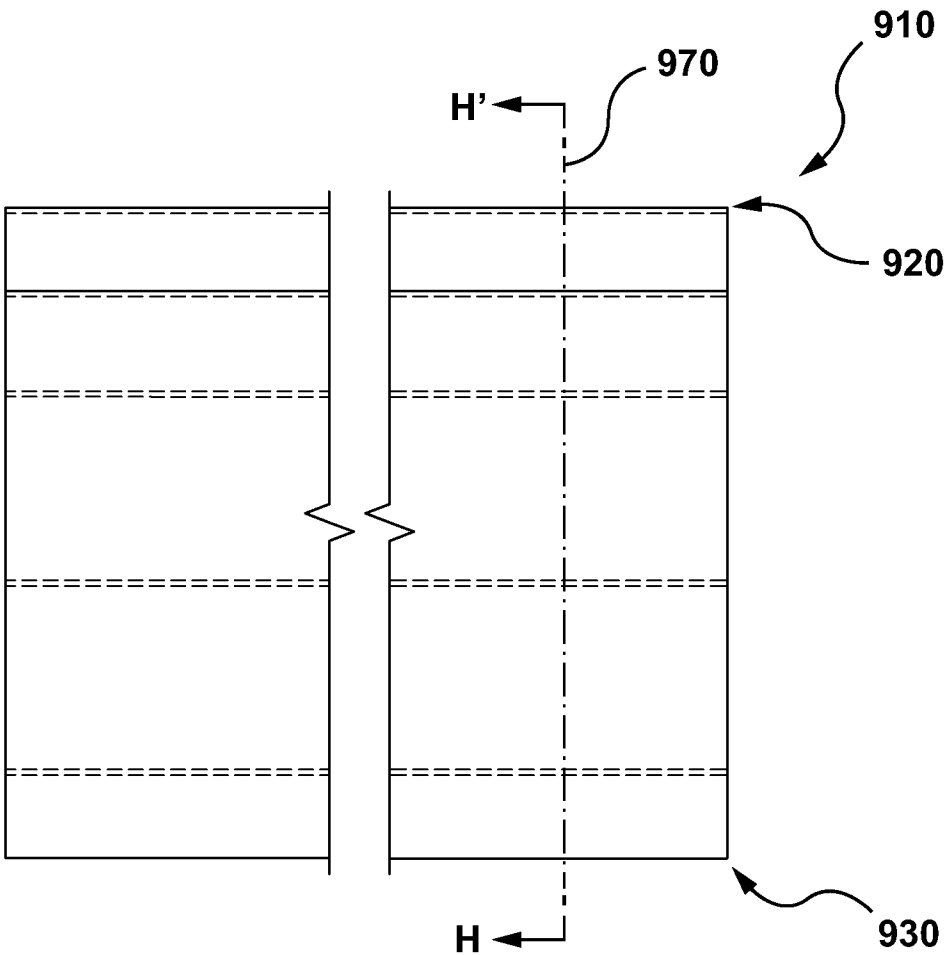
FIG. 20A illustrates a front view of a panel which can be used with the fence assembly of FIG. 1 and the frame assembly of FIG. 18A, according to certain embodiments of the present technology.
Figure 21B:
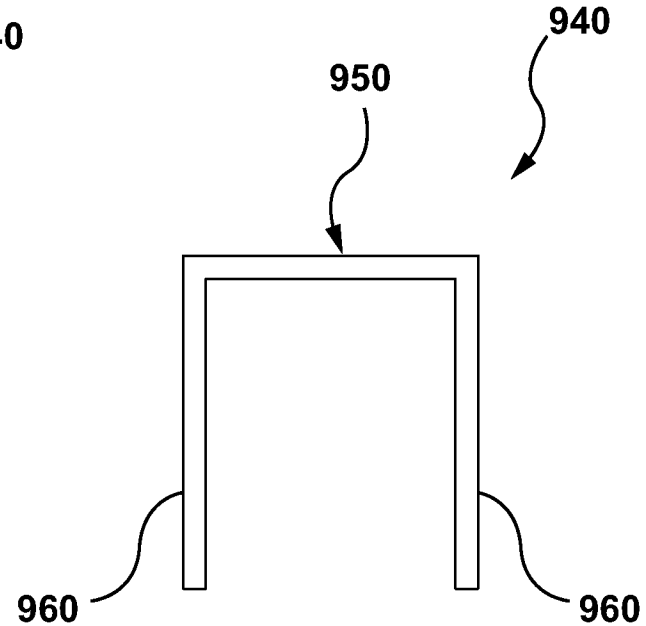
FIGS. 21A and 21B illustrates a plan view and a side view, respectively, of a panel cover according to certain embodiments of the present technology.
Figure 21A:
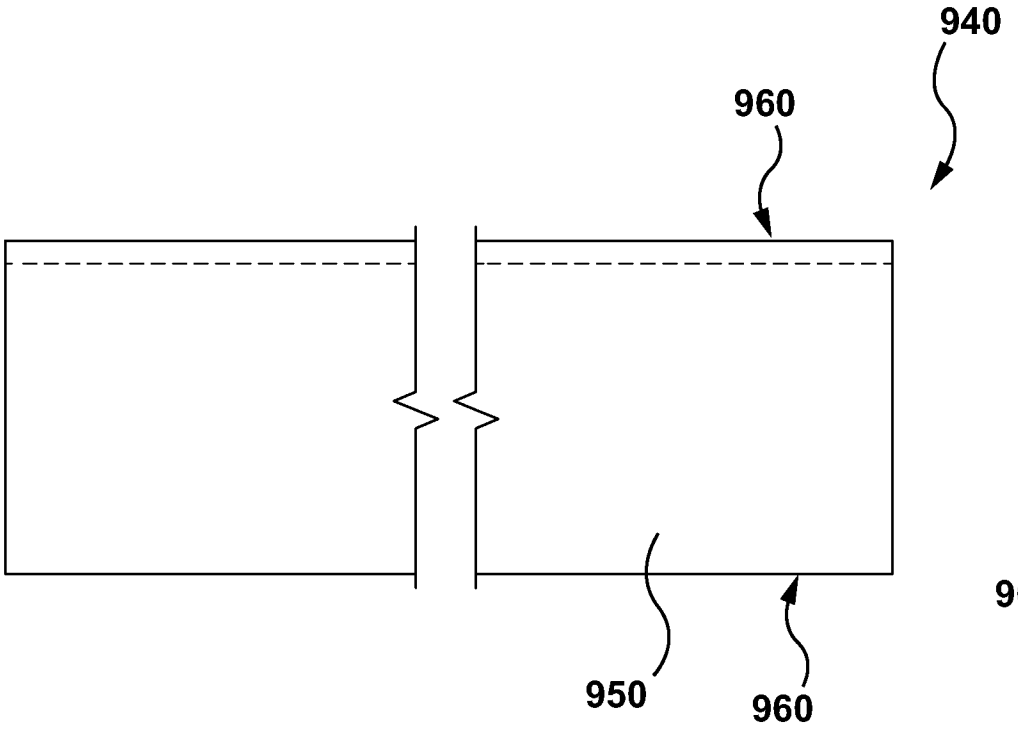

Turning now to FIGS. 20A and 20B, there is shown a panel 910 according to certain embodiments of the present technology configured to be supported by the support stud 160 and/or the rail channel 610 of the rail 180. As best seen in FIG. 20A, the panel 910 comprises a first end 920 and a second end 930, the first end 920 being narrower than the second end 930. The first end 920 is sized and shaped to be received between the arms 430 on the support surface 270 of the support stud 160 and/or in the rail channel 610. There may further be provided a panel cover 940 for covering the second end 930 of the panel 910, as exemplified in FIG. 21. The panel cover 940 comprises a panel cover body 950 being sized and shaped to cover the second end 930 of the panel 910, and a pair of panel cover arms 960, each panel cover arm 960 extending transversely from a respective side of the panel cover body 950 for placing over the second end 930 of the panel 910. In certain embodiments, a length of the panel 910 corresponds to a length of the rail 180 supporting said panel. This provides a safe and more durable fence assembly.

Embodiments of the fence assembly 10 of the present technology may comprise any one or more of the mount posts 20, rails 180, support studs 160, and panels 910 for creating a fence with a desired dimension or shape. For example, two mount post 20 with two rails 180 extending transversely therefrom may be provided thereby forming a top rail and bottom rail (as shown in FIG. 1). The top rail and bottom rail may have the panel 910 attached thereto to create a solid fence, the panel being received in the rail channel base portions of the top and bottom rails at its first and second ends. This creates a first fence unit. Further fence units may be added by the addition of a third mount post to create a second fence unit. By virtue of the mount post having more than one channel formed therein to attach rails, the second fence unit may be angled with respect to the first unit. According to the embodiments illustrated in FIG. 1, the first and second fence units will be angled transversely to one another. However, the present technology extends to mount posts in which channels are formed at different angles relative to one another to create fence units angled at less than or more than 90 degrees to each other. The second fence unit may also extend in the same direction as the first fence unit by attaching one or more rails to channels on opposing side of the mount post. Addition of additional mount posts 20 and rails 180, can thereby create a plurality of shapes desired for a given fence.

In other embodiments, the fence units can be created by one or more mount posts with support studs attached thereto (via one or more channels), and panels supported on the support surface and between the arms of the support stud.

Variations and modifications will occur to those of skill in the art after reviewing this disclosure. The disclosed features may be implemented, in any combination and subcombinations (including multiple dependent combinations and subcombinations), with one or more other features described herein. The various features described or illustrated above, including any components thereof, may be combined or integrated in other systems. Moreover, certain features may be omitted or not implemented. Examples of changes, substitutions, and alterations are ascertainable by one skilled in the art and could be made without departing from the scope of the information disclosed herein.

It should be appreciated that the invention is not limited to the particular embodiments described and illustrated herein but includes all modifications and variations falling within the scope of the invention as defined in the appended claims.

The invention claimed is:

1. A fence assembly comprising: a mount post having:

a mount post body with a longitudinal axis, the mount post body having a base end and a top end, a first channel defined at least in part by side walls in the mount post body and extending parallel to the longitudinal axis;

a support stud configured to be connected to the mount post and having a support surface to support a rail and/or a panel extending transversely from the mount post, the support stud comprising:

a support stud body having a tail portion and a head portion, the support stud configured to be inserted in the first channel with the tail portion first and such that a front face of the head portion faces outwardly from the first channel, and a bore extending from a first open bore end at the head portion to a second open bore end at the tail portion, the bore being sized and shaped to receive a fastener such that the fastener extends through the bore and beyond the second open bore end into the first channel for connecting the support stud to the mount post, wherein the bore comprises a first bore and a second bore, the first and second bores being divergent as they extend from the head portion towards the tail portion of the support stud.

2. The fence assembly of claim 1, wherein the mount post body has a second channel defined therein, extending parallel to the longitudinal axis, and spaced circumferentially from the first channel.

3. The fence assembly of claim 2, wherein the mount post body has a third channel defined therein, extending parallel to the longitudinal axis, and spaced circumferentially from the first and second channels.

4. The fence assembly of claim 1, wherein the side walls of the first channel have a step formed therein, the step defining: a channel base portion having a channel base width, and a channel mouth portion having a channel mouth width, the channel mouth width being larger than the channel base width, and the channel base portion being closer to the longitudinal axis than the channel mouth portion.

5. The fence assembly of claim 4, wherein the tail portion of the support stud has a tail portion width which is less than the channel base width such that the tail portion can extend into the channel base portion of the first channel, and the head portion of the support stud has a head portion width which is wider than the channel base width such that the head portion rests on a step and can not be received in the channel base portion.

6. The fence assembly of claim 1, wherein the second open bore end is at a junction of the tail portion and the head portion.

7. The fence assembly of claim 1, wherein the bore comprises a third bore between the first bore and the second bore, the third bore extending parallel to a central axis of the support stud.

8. The fence assembly of claim 7, wherein the first bore is angled at about 45 degrees from the central axis in one direction and the second bore is angled at about 45 degrees from the central axis in another direction.

9. The fence assembly of claim 1, wherein the front face of the head portion has an inset portion defined by inset walls, the first open bore end being defined in the inset walls.

10. The fence assembly of claim 9, wherein the inset walls have five sides angled with respect to one another, the first open bore end extending from one of the five sides.

11. The fence assembly of claim 10, wherein the bore comprises a first bore, a second bore and a third bore, the first and second bores being divergent as they extend from the head portion towards the tail portion of the support stud at an angle of 45 degrees respectively from the third bore, the first open end of the first bore, the second bore and the third bore being on respective adjacent faces of the inset wall.

12. The fence assembly of claim 1, further comprising a pair of arms extending upwardly from the front face of the support stud to define the support surface for the panel.

13. The fence assembly of claim 1, further comprising a first channel cover, the first channel cover having: a channel cover body sized and shaped to cover the first channel, and a pair of channel cover arms, each channel cover arm extending transversely from a respective side of the channel cover body and configured to be received in the first channel.

14. The fence assembly of claim 13, wherein each channel cover arm further comprises a protrusion extending transversely therefrom, there being provided a corresponding notch in the side walls of the first channel for receiving the protrusion.

15. The fence assembly of claim 1, further comprising a mount post base plate which can be attached to the base end of the mount post, the mount post base plate having base plate openings formed therein through which fasteners can be extended to attach to the mount post.

16. The fence assembly of claim 1, further comprising a mount post top cover which can be attached to the top end of the mount post, the mount post top cover being sized and shaped to cover the top end of the mount post.

17. The fence assembly of claim 1, further comprising the rail configured to be mounted to the mount post transversely to the longitudinal axis, the rail comprising two free ends, each free end sized and shaped to be received in the first channel; and the rail being four-sided, one of the four-sides having a rail channel formed therein.

18. The fence assembly of claim 17, further comprising a rail channel cover, the rail channel cover having: a rail channel cover body sized and shaped to cover the rail channel, and a pair of rail channel cover arms, each channel cover arm extending transversely from a respective side of the rail channel cover body and configured to be received in the rail channel.

19. The fence assembly of claim 18, wherein each rail channel cover arm further comprises a protrusion extending transversely therefrom, there being provided a corresponding notch in the side walls of the rail channel for receiving the protrusion.

* * * * *